US006283097B1

(12) United States Patent
Cook et al.

(10) Patent No.: US 6,283,097 B1
(45) Date of Patent: Sep. 4, 2001

(54) AUTOMOTIVE EVAPORATIVE EMISSION LEAK DETECTION SYSTEM

(76) Inventors: John E. Cook, 17 Kingsway Drive, Chatham, Ontario (CA), N7L 2S8; Paul D. Perry, 82 Gladstone Avenue, Chatham, Ontario (CA), N7L 2C3; Craig A. Weldon, 45 Riverview, Apt. 302, Chatham, Ontario (CA), N7M 6B8

( * ) Notice: Subject to any disclaimer, the term of this patent is extended or adjusted under 35 U.S.C. 154(b) by 0 days.

(21) Appl. No.: 08/918,065

(22) Filed: Aug. 25, 1997

(51) Int. Cl.[7] ..... F02M 37/04
(52) U.S. Cl. ..... 123/520; 123/198 D; 123/494
(58) Field of Search ..... 123/520, 519, 123/518, 516, 198 D, 494

(56) References Cited

U.S. PATENT DOCUMENTS

| | | | | |
|---|---|---|---|---|
| 4,991,560 | * | 2/1991 | Arai et al. | 123/494 |
| 5,146,902 | | 9/1992 | Cook et al. . | |
| 5,205,263 | | 4/1993 | Blumenstock et al. . | |
| 5,245,973 | | 9/1993 | Otsuka et al. . | |
| 5,267,470 | | 12/1993 | Cook . | |
| 5,297,529 | | 3/1994 | Cook et al. . | |
| 5,383,437 | | 1/1995 | Cook et al. . | |
| 5,390,645 | | 2/1995 | Cook et al. . | |
| 5,408,866 | | 4/1995 | Kawamura et al. . | |
| 5,411,004 | | 5/1995 | Busato et al. . | |
| 5,441,031 | | 8/1995 | Kiyomiya . | |
| 5,460,141 | | 10/1995 | Denz et al. . | |
| 5,474,050 | | 12/1995 | Cook et al. . | |
| 5,490,414 | | 2/1996 | Durschmidt et al. . | |
| 5,499,614 | | 3/1996 | Busato et al. . | |
| 5,509,296 | | 4/1996 | Kolb . | |
| 5,542,397 | | 8/1996 | Takahata et al. . | |
| 5,553,577 | | 9/1996 | Denz et al. . | |
| 5,697,348 | * | 12/1997 | Schwager | 123/520 |
| 5,730,107 | * | 3/1998 | Blumenstock | 123/520 |
| 5,806,500 | * | 9/1998 | Fargo et al. | 123/520 |
| 5,845,625 | * | 12/1998 | Kidokoro et al. | 123/520 |
| 5,850,819 | * | 12/1998 | Kunimitsu et al. | 123/520 |
| 5,878,728 | * | 3/1999 | Kidokoro et al. | 123/520 |
| 5,967,124 | * | 10/1999 | Cook et al. | 123/520 |
| 5,992,396 | * | 11/1999 | Krimmer et al. | 123/519 |
| 6,053,151 | * | 4/2000 | Cook et al. | 123/520 |

* cited by examiner

*Primary Examiner*—Carl S. Miller

(57) ABSTRACT

A leak detection system for detecting leakage from a portion of a vapor confinement space which is upstream of an inlet of a canister purge valve relative to an engine. During a test, an electric-motor-operated air pump pumps atmospheric air through a flowpath providing communication between the pump and the vapor confinement space. A flowmeter has a thermistor in the flowpath. The thermistor has a predetermined temperature vs. electric current characteristic that enables it to provide a signal correlated to flow of air through the flowpath. An electric circuit supplies and measures the electric current drawn by the thermistor to create a signal representative of the pumped airflow. The test is conducted in accordance with an algorithm that pre-heats the thermistor to a stable state before the pump is turned on. The pump is then turned on to create a predefined superatmospheric target pressure in the vapor confinement space. Once the target pressure is reached, the airflow measured by the flowmeter provides a leakage measurement. The pump is then shut off and the vapor space vented to atmosphere through the flowmeter and pump. The thermistor current draw is once again measured to detect any drift in its characteristic.

48 Claims, 10 Drawing Sheets

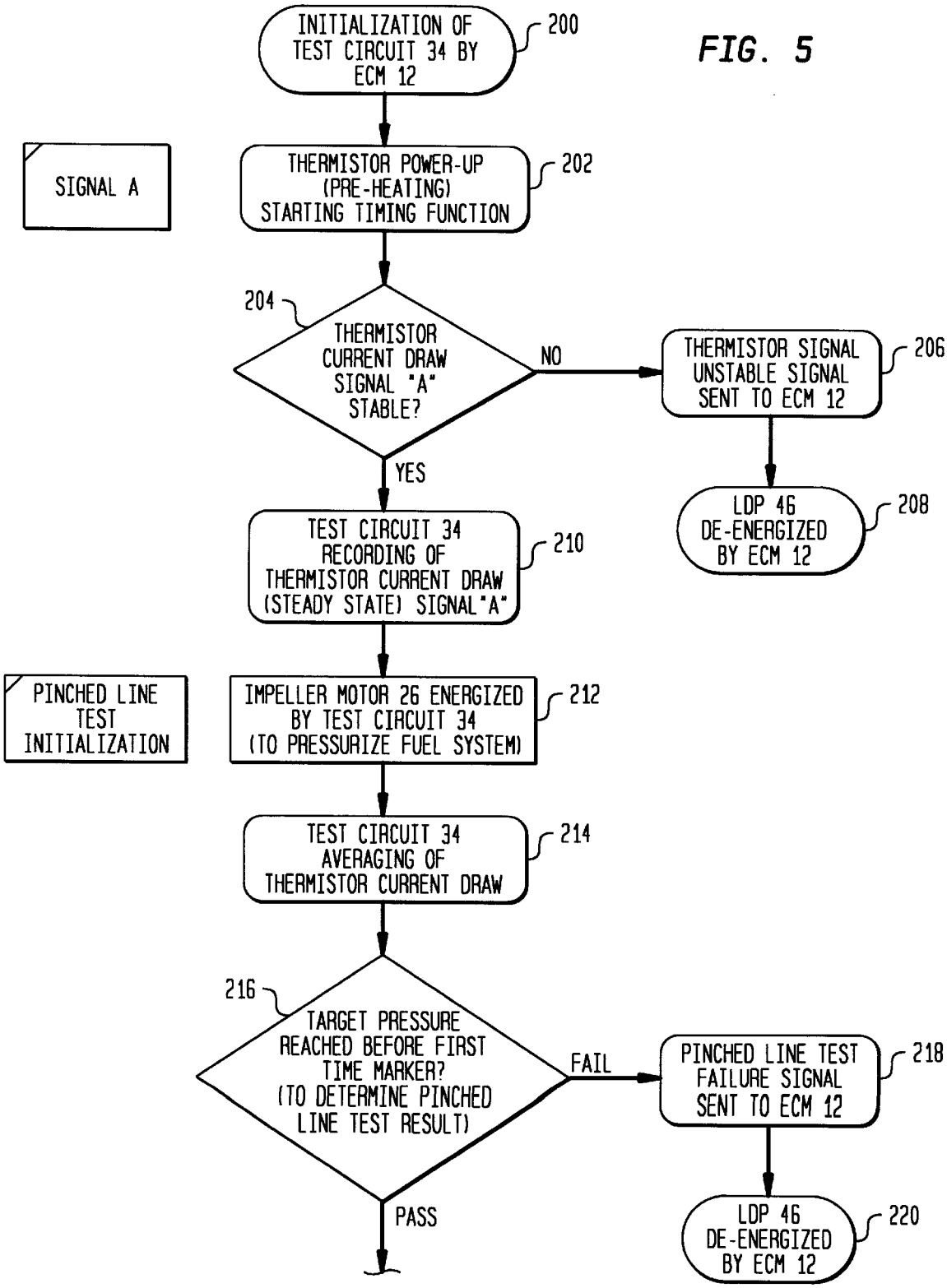
FIG. 5
INITIALIZATION OF TEST CIRCUIT 34 BY ECM 12
200
SIGNAL A
THERMISTOR POWER-UP (PRE-HEATING) STARTING TIMING FUNCTION
202
204
THERMISTOR CURRENT DRAW SIGNAL "A" STABLE?
NO
THERMISTOR SIGNAL UNSTABLE SIGNAL SENT TO ECM 12
206
LDP 46 DE-ENERGIZED BY ECM 12
208
YES
TEST CIRCUIT 34 RECORDING OF THERMISTOR CURRENT DRAW (STEADY STATE) SIGNAL "A"
210
PINCHED LINE TEST INITIALIZATION
IMPELLER MOTOR 26 ENERGIZED BY TEST CIRCUIT 34 (TO PRESSURIZE FUEL SYSTEM)
212
TEST CIRCUIT 34 AVERAGING OF THERMISTOR CURRENT DRAW
214
216
TARGET PRESSURE REACHED BEFORE FIRST TIME MARKER? (TO DETERMINE PINCHED LINE TEST RESULT)
FAIL
PINCHED LINE TEST FAILURE SIGNAL SENT TO ECM 12
218
PASS
LDP 46 DE-ENERGIZED BY ECM 12
220

AUTOMOTIVE EVAPORATIVE EMISSION LEAK DETECTION SYSTEM

FIELD OF THE INVENTION

This invention relates generally to an on-board system for detecting fuel vapor leakage from an evaporative emission control system of an automotive vehicle. More specifically, it relates to a novel leak detection pump and flowmeter assembly for testing the integrity of an evaporative emission control system against leakage.

BACKGROUND AND SUMMARY OF THE INVENTION

A previous leak detection system employs a differential flow sensing principle for detecting fuel vapor leakage from the evaporative emission system of an automotive vehicle during a leakage test that involves closing the canister purge solenoid (CPS) valve and then positively pressurizing that portion of the evaporative emission system that is upstream of the CPS valve relative to the engine. One of the advantages of that leak detection system is that it less complicated than earlier known leak detection systems, and hence more economical and reliable, than prior known systems not using the differential flow sensing principle.

Another leak detection system utilizes a differential flow sensing principle, but does so in a way that is less influenced by certain variables, such as ambient temperature, pressure, engine manifold vacuum, or supply voltage.

Both of these leak detection systems utilize calibrated orifices, in conjunction with flow sensors and associated electronics as elements of the leak detectors.

The present invention is directed toward an on-board system for detecting fuel vapor leakage from an evaporative emission control system of an automotive vehicle.

Briefly, one aspect of the present invention relates to a novel organization and arrangement of a pressurizing pump, a single flowmeter, including associated electric signal processing for a signal obtained from the flowmeter, and a valve mechanism: that collectively allow an evaporative emission space to be quickly pressurized to appropriate test pressure at the beginning of a leak detection test, but will abort the test if conditions not conducive to obtaining an accurate result are discovered; that assure test accuracy by providing substantial insensitivity to extraneous disturbances during a test; that assure test accuracy by identification of test results obtained during conditions not conducive to attainment of an accurate result; that are well-suited for long-term reliability of test results by compensating for age-induced changes in the flowmeter characteristics; and that can be efficiently packaged into an assembly that is adapted for installation in a specific model of automotive vehicle by utilizing a specific adapter part for that model.

A preferred embodiment of the present invention comprises an electric-operated impeller pump for pressurizing the evaporative emission space under test, a cylindrical flow channel through which the impeller pump pressurizes the evaporative emission space under test, a single thermistor whose body is disposed in the flow channel to sense flow through the channel, electric signal processing associated with the thermistor for processing a signal obtained from the thermistor, and a valve mechanism which allows atmospheric air to be rapidly drawn into the impeller pump during pressurizing of the space under test, and which, once appropriate test pressure has been developed in the space under test, provides a restriction that is beneficial in rendering the leak detection test substantially insensitive to certain extraneous disturbances which otherwise might impair test accuracy.

Moreover, a specific presently preferred test procedure employs an algorithm that initially performs a "pinched-line" test, and upon its successful passage, a leak detection test. It also performs a self-test of the thermistor and associated signal processing so that any drift in the thermistor characteristics is noted and automatically compensated for.

A preferred practice which is disclosed hereinafter for pressurizing the evaporative emission space under test comprises conducting the pressurizing airflow into the space via the vapor collection canister's (charcoal canister's) atmospheric vent port to create a superatmospheric pressure for use in leak detection. Because the impeller pump provides an open passage through itself when not being operated, the association of an assembly embodying the present invention with an evaporative emission space allows the pumped air flow to be communicated to the canister vent port without adversely affecting atmospheric venting of the evaporative emission space through the canister vent port during times of non-testing.

The compactness of a leak detection pump and flowmeter assembly which embodies principles of the present invention can provide spatial economy that may be especially important to many automobile manufacturers. A unitary leak detection pump and flowmeter assembly also has the advantage of requiring fewer connections of components in an automotive assembly plant, and this affords an opportunity for installation cost savings while at the same time an opportunity for increased reliability of installation. A unitary leak detection pump and assembly may be integrated with a canister, or remotely located and communicated to the vapor confinement space by a conduit.

The generic principles of the invention extend however to embodiments that are non-unitary, that is to embodiments where, for example, a pump may be remotely located from a leak detection assembly and/or a leak detection assembly may be located remotely from a canister. In the design of certain vehicles, the ability to locate various components in various locations may be important for packaging purposes. Suitable conduits communicate the remotely located components.

The inventive leak detection pump and flowmeter assembly possesses significant economies of scale in its manufacture because all major component parts can be commonly mass-produced and assembled with only a special adapter part being required for adapting the assembly to a particular vehicle model.

Accordingly, in one general respect, the invention relates to a leak detection system for detecting leakage from a portion of a vapor confinement space which is upstream of an inlet of a canister purge valve relative to an engine and comprises: a pump for pumping a gaseous medium; a flowpath providing communication between the pump and the vapor confinement space; a flowmeter for measuring flow of gaseous medium through the flowpath; the flowmeter comprising an electric circuit element disposed in the flowpath to be exposed to flow of gaseous medium through the flowpath; the electric circuit element having a predetermined temperature vs. electric current characteristic that enables the electric circuit element to provide a signal correlated to flow of gaseous medium through the flowpath; and an electric circuit to which the electric circuit element is operatively connected for supplying electric current to the electric circuit element and for creating a signal representative of electric current flow through the electric circuit element, and hence of flow of gaseous medium through the flowpath.

In another general respect, the invention relates to a leak detection system for detecting leakage from a portion of a vapor confinement space which is upstream of an inlet of a canister purge valve relative to an engine and comprises: a pump for pumping a gaseous medium; a flowpath providing communication between the pump and the vapor confinement space; a flowmeter for measuring flow of gaseous medium through the flowpath; and in which the pump comprises an outlet communicated via the flowpath to the vapor confinement space and an inlet that is selectively communicated to atmosphere via a valve, means causing the valve to be open while the pump operates to pressurize the vapor confinement space to a predetermined superatmospheric pressure, and means causing the valve to be closed when the pressure in the vapor confinement space is at the predetermined superatmospheric pressure.

In still another general respect, the invention relates to an assembly for use in a leak detection system operatively associated with the evaporative emission control system of an engine powered automotive vehicle for detecting leakage from a portion of a vapor confinement space which is upstream of an inlet of a canister purge valve relative to an engine, wherein the assembly comprises: a housing comprising a first port adapted to be communicated to a pump, a second port adapted to be communicated to a vapor confinement space, and two parallel branches in that portion of the flowpath that passes through the housing; a flowmeter for measuring flow of gaseous medium through the flowpath; and a valve for allowing and disallowing flow through one of the two branches.

In a still further general respect, the invention relates to a leak detection system for detecting leakage from a portion of a vapor confinement space which is upstream of an inlet of a canister purge valve relative to an engine and comprises: a pump for pumping a gaseous medium; a flowpath providing communication between the pump and the vapor confinement space; a flowmeter for measuring flow of gaseous medium through the flowpath; an electric circuit for selectively operating the pump and for processing the gaseous flow measurement of the flowmeter in accordance with an algorithm that comprises means for causing the electric circuit to detect a first state of stability of the gaseous flow measurement of the flowmeter while the pump is running, means for causing the electric circuit to detect a second state of stability of the gaseous flow measurement of the flowmeter while the pump is not running, and means for causing the electric circuit to process the value of the first state of stability of the gaseous flow measurement of the flowmeter and the value of the second state of stability of the gaseous flow measurement of the flowmeter.

In a still further general respect, the invention relates to a leak detection system for detecting leakage from a portion of a vapor confinement space which is upstream of an inlet of a canister purge valve relative to an engine and comprises: pumping a gaseous medium through a flowpath that communicates the vapor confinement space to atmosphere; measuring flow of gaseous medium through the flowpath; selectively operating the pump and processing the gaseous flow measurement of the flowmeter in accordance with an algorithm that detects a first state of stability of the gaseous flow measurement of the flowmeter while the pump is running, that detects a second state of stability of the gaseous flow measurement of the flowmeter while the pump is not running, and processing the value of the first state of stability of the gaseous flow measurement of the flowmeter and the value of the second state of stability of the gaseous flow measurement of the flowmeter.

The foregoing, along with further features, advantages, and benefits of the invention, will be seen in the ensuing description and claims, which are accompanied by drawings. The drawings, which are incorporated herein and constitute part of this specification, illustrate the presently preferred embodiments of the invention according to the best mode contemplated at this time for carrying out the invention.

BRIEF DESCRIPTION OF THE DRAWINGS

FIGS. 5, 5A, and 5B collectively show a flow diagram of a leak detection test procedure employing a leak detection pump and flowmeter assembly embodying principles of the invention.

DESCRIPTION OF THE PREFERRED EMBODIMENT

Figure 1:
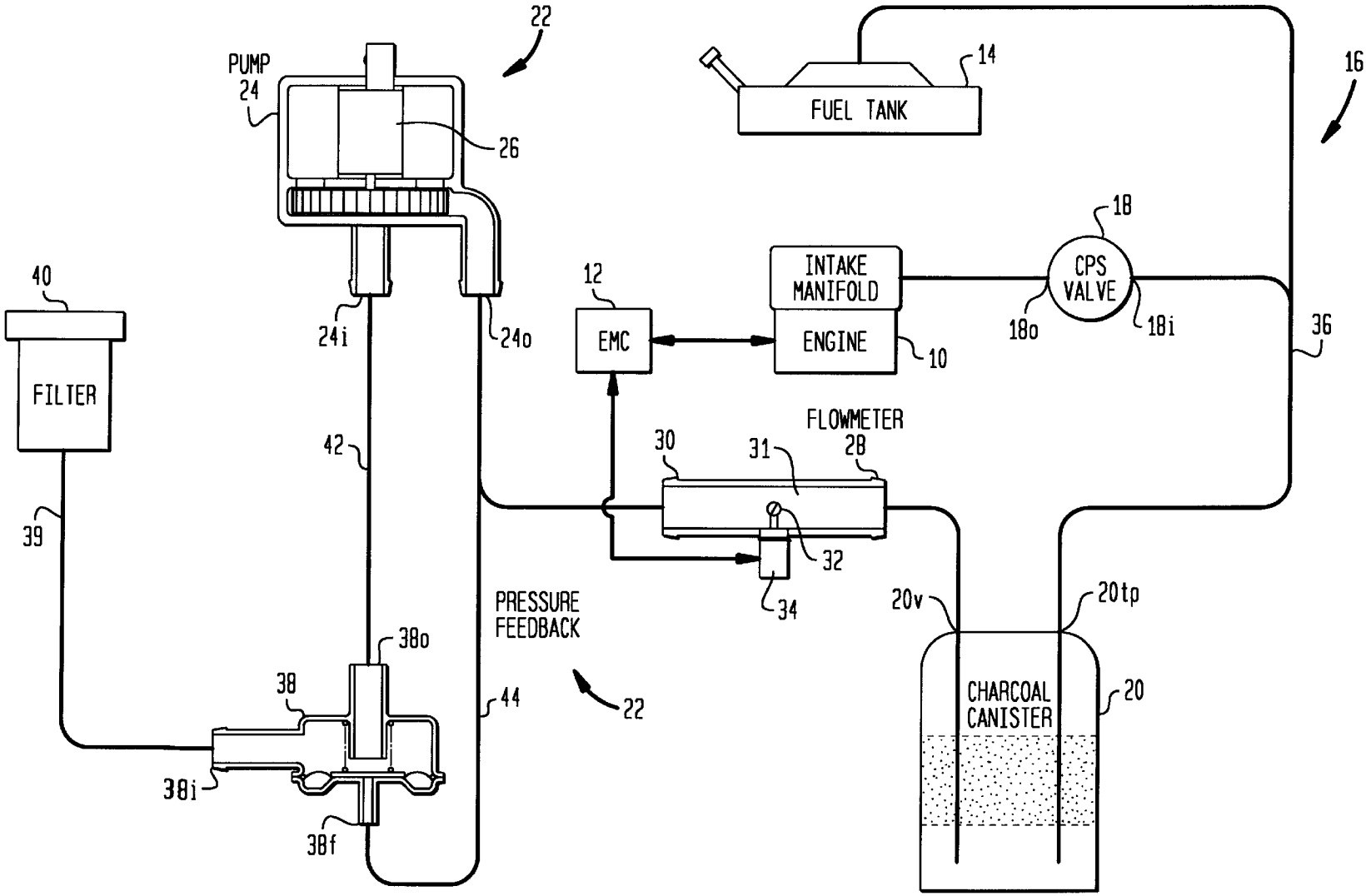
FIG. 1 is a general schematic diagram of an automotive vehicle evaporative emission control system including a leak detection pump and flowmeter assembly embodying principles of the invention.

FIG. 1 shows an exemplary application of the inventive principles to an automotive vehicle that is powered by an internal combustion engine 10 that is controlled by an electronic engine control module (ECM) 12 that comprises a microprocessor and associated electronics. The vehicle comprises a fuel tank 14 for storing a volatile fuel such as gasoline that is vaporized and combusted in the engine's combustion chamber space.

The associated evaporative emission control system is designated generally by the reference numeral 16 and comprises: a known canister purge solenoid (CPS) valve 18 having inlet and outlet ports 18*i* and 18*o* respectively; and a vapor collection canister (sometimes called a charcoal canister) 20 having a tank/purge port 20*tp* and a vent port 20*v*.

The leak detection system embodying principles of the invention is shown generally at 22 and comprises an impeller pump 24 operated by an electric motor 26. Impeller pump 24 has an air inlet port 24*i* and an air outlet port 24*o*. When motor 26 is energized during a test, pump 24 is capable of pressurizing the evaporative emission space under test, and when the motor is not energized, the pump provides a vent path for venting canister vent port 20*v* to atmosphere.

Leak detection system 22 comprises a series flow path from pump outlet port 24*o* to tank vent port 20*v*. This flow path contains an airflow meter 28 comprising a tubular wall 30 forming a flow channel 31 of predetermined cross section and a flow sensing element 32, in the form of a single thermistor, situated within the flow channel. The tubular wall 30 is preferably cylindrical, however, the tubular wall could also be square. Thermistor 32 possesses a predefined temperature vs. electric current characteristic for creating a signal correlated to airflow through flow channel 31.

Thermistor 32 is operatively connected with certain portions of an electronic test circuit 34 that is in electrical communication with ECM 12. ECM 12 typically comprises a microprocessor that, in addition to controlling various engine-related functions and/or conducting various diagnostic tests, periodically signals test circuit 34 to perform a leak detection test. After circuit 34 has been signaled to perform a leak detection test, it causes electric current to pass through thermistor 32 and then measures that current to develop a signal representing flow through flow channel 31. A detailed description of the operation of thermistor 32 and test circuit 34 will be presented later.

Canister tank/purge port 20*tp*, the headspace of tank 14, and inlet port 18*i* of CPS valve 18 are in common communication via a flow path 36. Outlet port 18*o* of CPS valve 18 is fluid-coupled to engine intake manifold vacuum that is produced when engine 10 is running.

A valve 38 comprises an air inlet port 38*i*, an air outlet port 38*o*, and a feedback port 38*f*. Inlet port 38*i* is communicated through a flow path 39 to atmosphere via a particulate filter 40, while outlet port 38*o* is communicated to pump inlet port 24*i* via a flow path 42. Feedback port 38*f* is communicated with pump outlet port 24*o* via a flow conduit 44 for enabling valve 38 to sense the pressure at port 24*o*.

Figure 2:
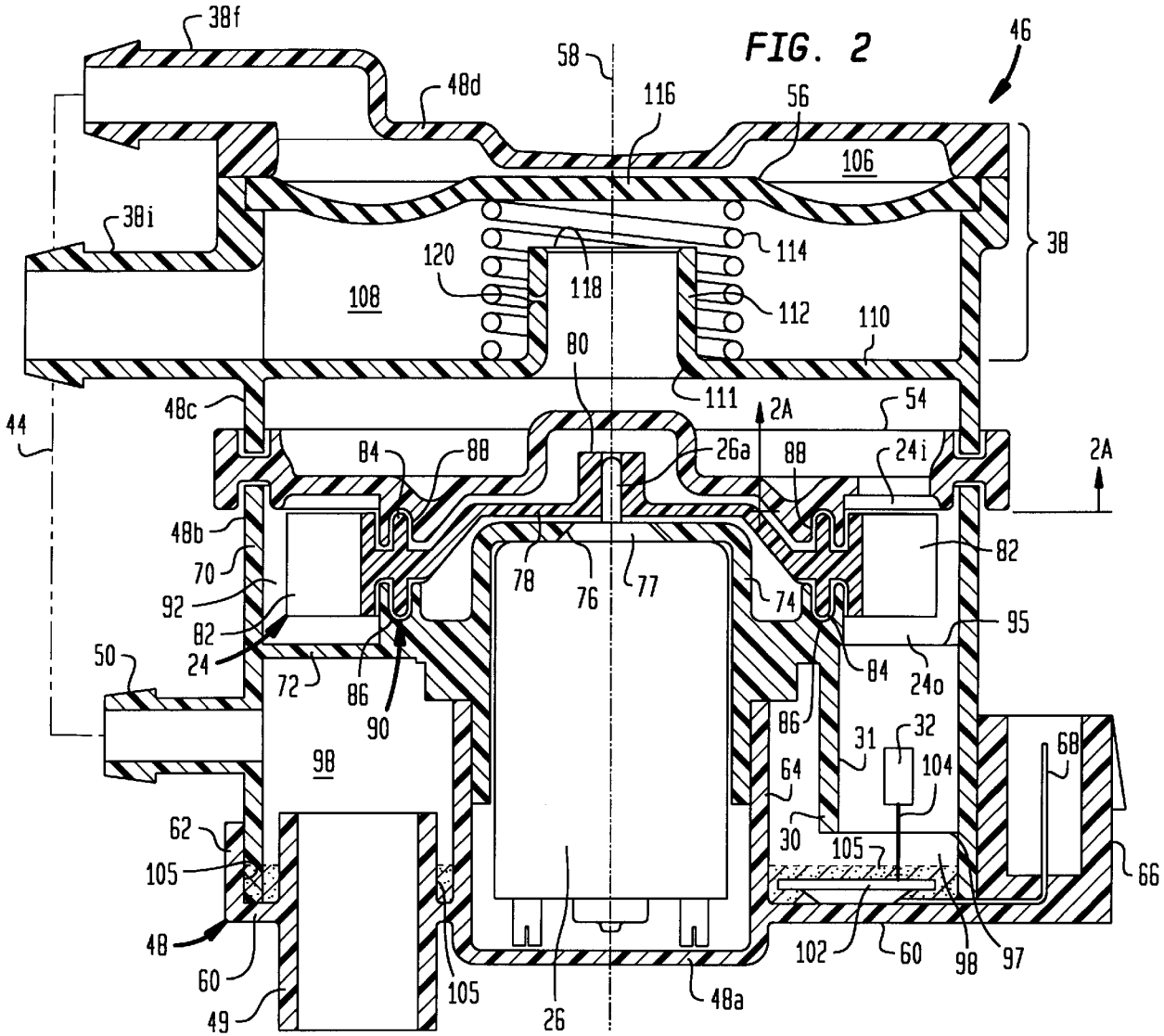
FIG. 2 is a longitudinal cross section view through a unitary leak detection pump and flowmeter module embodying principles of the invention.
Figure 3:
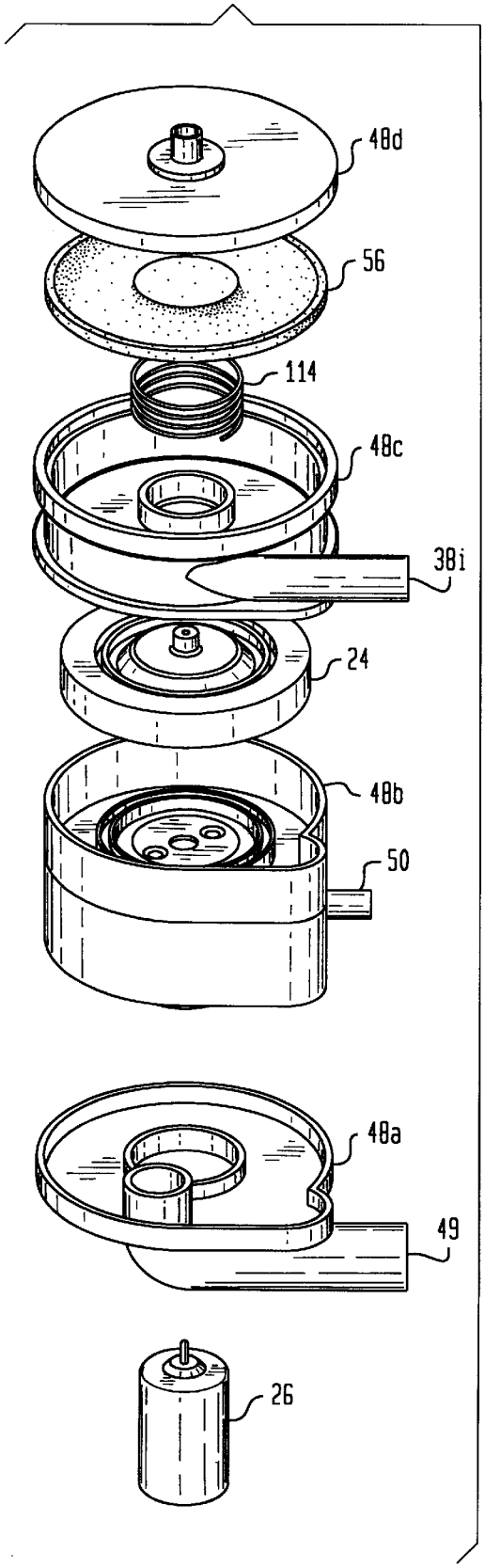
FIG. 3 is an exploded perspective view from one direction of certain components of a unitary leak detection pump and flowmeter module embodying principles of the invention.
Figure 4:
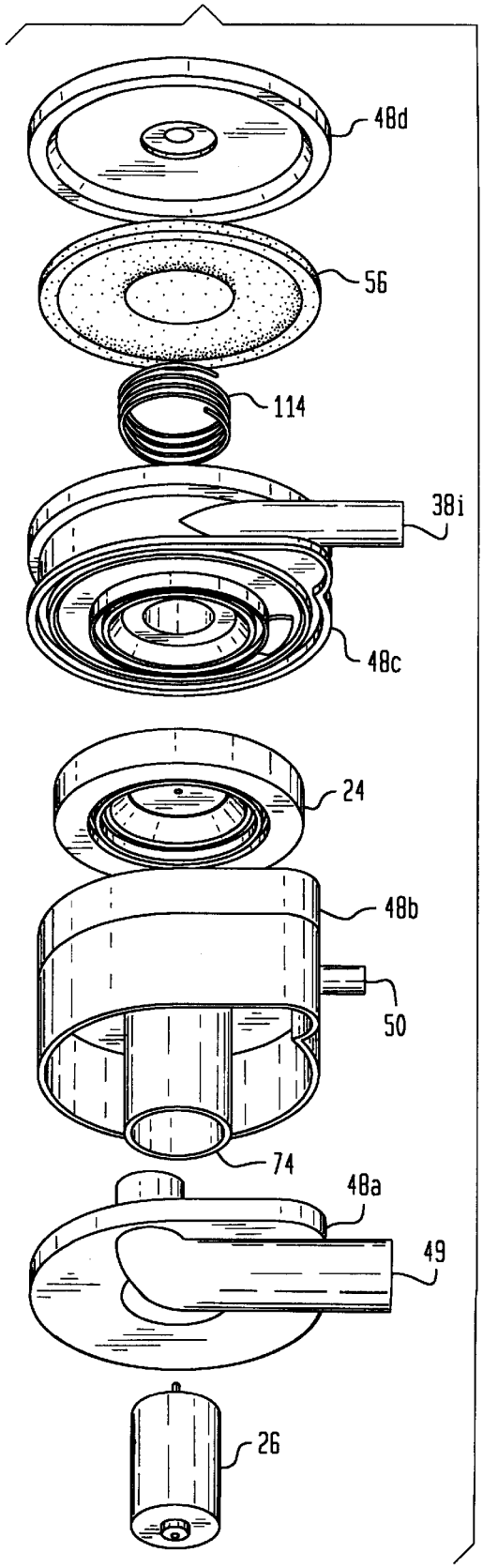
FIG. 4 is an exploded perspective view from another direction of the components of FIG. 3.

Impeller pump 24, electric motor 26, and flowmeter 28 are embodied in a leak detection pump and flowmeter assembly, or LDP module, 46 shown in FIG. 2. FIGS. 3 and 4 show exploded perspective views of certain of the assembly's components. Assembly 46 comprises a housing 48 forming an enclosure that embodies port 38*i* as a nipple for receiving an end of conduit 39, the conduit not being specifically shown in FIG. 2. A tube 49 provides for the assembly to be fluid-connected to canister vent port 20*v*. Housing 48 has two more nipples, one of which forms port 38*f* while the other 50 is for communicating pump outlet pressure as feedback to port 38*f* through flow conduit 44.

Housing 48 comprises several parts assembled together. The lowermost part in FIG. 2 is a housing adapter part 48*a*. It closes the open lower end of a lower body housing part 48*b*, forming a gas-tight joint between them. The lower end of an upper body housing part 48*c* cooperates with the upper end of part 48*b* to capture an impeller cap 54 between them, forming a gas-tight joint between the parts. Finally, a housing cap part 48*d* cooperates with the upper end of part 48*c* to capture the outer peripheral margin of a diaphragm 56 of valve 38 between them, forming a gas-tight joint. Housing parts 48*a*, 48*b*, 48*c*, 48*d*, impeller cap 54, and diaphragm 56 are coaxially arranged along a main longitudinal axis 58 of the assembly and are generally cylindrically shaped.

Housing adapter part 48*a* has a generally circular end wall 60 with a short upstanding perimeter flange 62 for fitting closely over the lower circular end of lower body housing part 48*b* to form a gas-tight joint between them. The central region of part 48*a* has an integrally formed cylindrical-walled cup 64 coaxial with axis 58. Tube 49 is spaced radially of, but parallel with, axis 58 to one side of cup 64, and this tube is integrally formed in part 48*a* to extend through end wall 60. Exterior of housing 48, adapter part 48*a* is provided with an electric connector shell 66 that surrounds plural electric terminals, designated 68 generally, and forms a connector for mating with a complementary connector shell (not shown) that contains terminals for mating with terminals 68 to electrically connect assembly 46 with ECM 12 and with the vehicle's electric power supply, typically 12 VDC.

Lower body housing part 48*b* comprises a circular cylindrical side wall 70 that is internally spanned by a transverse wall 72. Air outlet port 24*o* of pump 24 is provided as a hole in wall 72 at a circumferential location proximate side wall 70. At its center, wall 72 is formed with an integral inverted cup 74 whose rim fits closely within that of cup 64 so that the two cups cooperatively form a motor mount that captures the body of motor 26 therein such that the motor's axis is coincident with axis 58. Inverted cup 74 comprises a hole 76 that is centered on axis 58 around a motor bushing housing 77 at the end of the motor's housing to allow an external end of the shaft 26*a* of motor 26 to protrude from the motor mounting. Pump 24 comprises an impeller 78 having a central hub 80 that fits onto and is secured to the protruding portion of the motor shaft 26*a*. In this way, operation of motor 26 will rotate impeller 78 about axis 58 to operate the pump.

Impeller 78 further comprises a number of vanes, or blades, 82 that are supported around its outer perimeter, much as in a paddle wheel. Radially inward of vanes 82, impeller 78 has an integral cylindrical ring 84 that extends to both axial sides of the impeller. Wall 72 and impeller cap 54 have circular grooves 86, 88 respectively, that coact respectively with the circular opposite axial ends of ring 84 to form a circular aerodynamic, or labyrinth, seal 90 to the radially inward side of vanes 82 when the impeller is operated by motor 26. Thus, the impeller vanes are disposed within an annular space 92 bounded radially by seal 90 and housing side wall 70, and axially by impeller cap 54 and the radially outer margin of wall 72.

The vaned portion of impeller 78 may be considered to have opposite axial faces. One axial face closely confronts impeller cap 54 while the opposite face confronts wall 72. Impeller cap 54 comprises a hole that forms pump inlet 24*i*. Wall 72 comprises a hole that forms pump outlet 24*o*. When operated by motor 26, impeller 78 is effective to draw air through the hole forming inlet 24*i*, into space 92, and thence discharge the air through the hole forming outlet 24*o*.

Figure 2A:
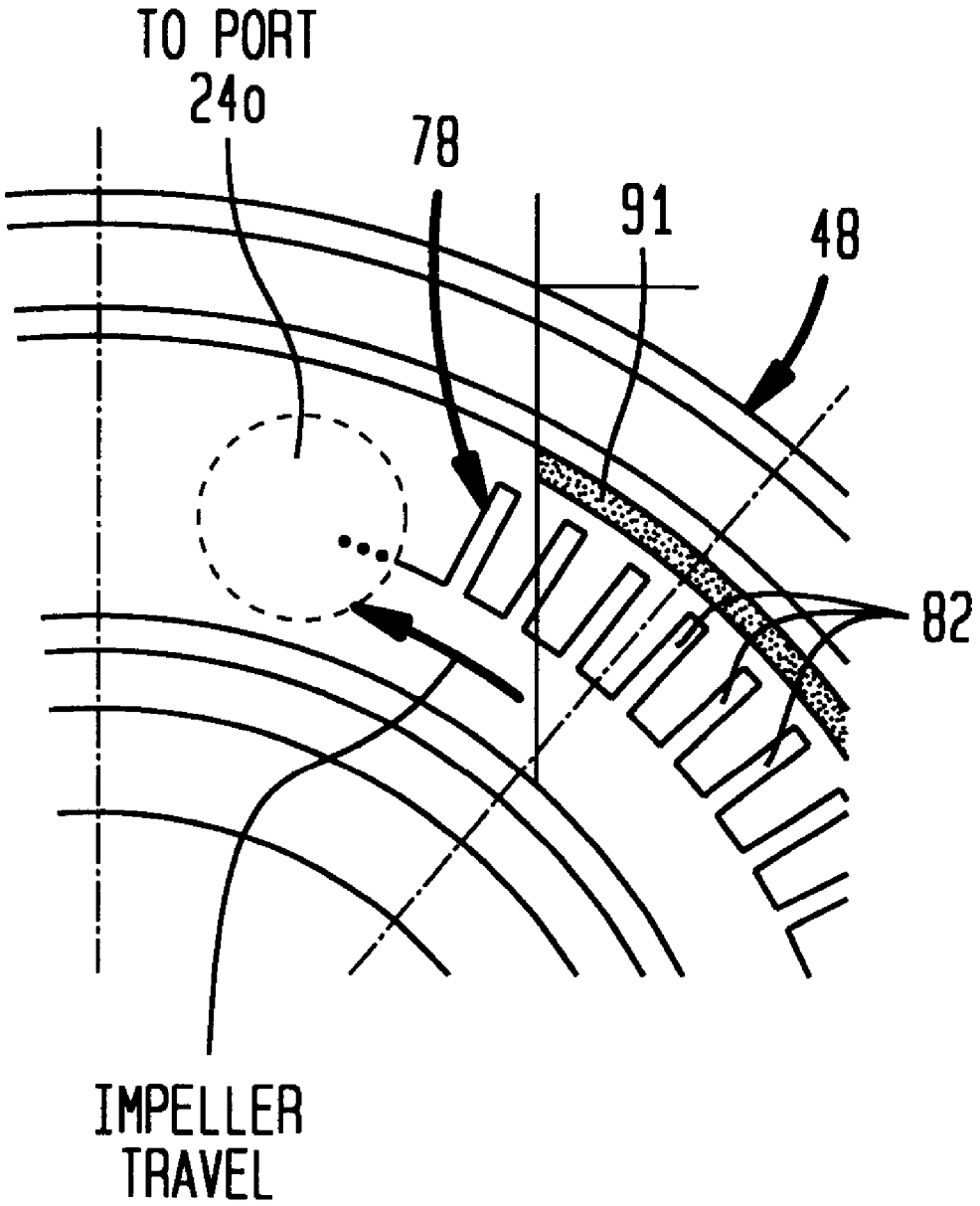
FIG. 2A is a fragmentary view, approximately at line 2A—2A in FIG. 2, that is presented for illustrative purposes to show a feature that cannot be conveniently depicted in FIG. 2.

So that impeller 78 will be effective for its intended purpose when operated by motor 26, FIG. 2A shows that a limited circumferential extent of housing side wall 70 is shaped as an intrusion that comes sufficiently close to the vaned portion of the impeller, but without interference with the impeller, so as to create an air dam 91 when the impeller is operated by the electric motor. This air dam, or "pinch point", is located such that operation of the impeller is effective to draw air through inlet 24*i* and into space 92, and thence impel the air out through port 24*o* so that pumped air flows through flow channel 31, into space 98, and thence out tube 49. FIG. 2A shows a representative circumferential relation of ports 24*i* and 24*o* and the location of the intrusion formed in the side wall 70 of housing part 48*b* to create air dam 91. The area at port 24*i* is on the atmospheric pressure side of the impeller while port 24*o* is at the positive pressure side when the impeller operates. In view of the description relating to FIG. 2A, it should be noted that FIG. 2 shows inlet port 24*i* out of true position relative to outlet port 24*o*.

The hole forming outlet 24*o* is at an entrance 95 of flow channel 31. Flow channel 31 has an axis parallel with, but spaced radially from, axis 58, and it is integrally formed in housing part 48*b*. The flow channel further has an exit 97 that is opposite entrance 95, but stops short of housing end wall 60. Exit 97 leads to an annular space 98 that is disposed circumferentially about the motor mounting and lies axially between walls 72 and 60. Tube 49 is integrally formed as part of end wall 60 and has an axis that is parallel with, but spaced radially from, axis 58, to provide an outlet flow path from space 98 to canister vent port 20*v*. Module 46 may be mounted directly on canister 20, or else located remotely and communicated to the canister by a suitable conduit.

Test circuit 34 is packaged in any suitable manner, such as on a circuit board 102, and disposed proximate both flow channel wall 30 and shell 66. Terminals 68 have electric connection to electric circuitry on board 102. Thermistor 32 has leads 104 that extend from a circuit portion on board 102 to enable the thermistor body to be disposed within flow channel 31 where it is surrounded circumferentially by wall 30. FIG. 2 shows thermistor 32 to be disposed generally on the axis of the flow channel, which is preferably circular cylindrical, but could also be square. Circuit board 102 and the circuit thereon, except for the portion of thermistor 32 that protrudes into flow channel 31, are encapsulated in a layer of suitable encapsulant 105 on the inside of wall 60.

Valve 38 is disposed at the opposite axial end of housing 48 from end wall 60. The valve is cooperatively formed by housing parts 48*c* and 48*d* capturing the outer margin of diaphragm 56 between them to form respective chamber spaces 106, 108 on opposite sides of diaphragm 56. Housing part 48*c* comprises an internal transverse wall 110 containing an open center 111 which merges into a circular cylindrical tube 112 that is coaxial with axis 58 and protrudes a short distance into chamber space 108. One end of a helical coil compression spring 114 seats on wall 110, spaced radially outward a short distance from tube 112. The other end of spring 114 bears against an outer margin of a central region 116 of diaphragm 56, which may be rigidified by a suitable insert (not specifically shown in FIG. 2), such that region 116 is resiliently biased away from the free end of tube 112. The central diaphragm region 116 forms a movable valve element of valve 38 while the free end of tube 112 forms a valve seat 118 which respect to which region 116 selectively seats and unseats. FIG. 2 shows an unseated position wherein valve 38 is open. Additionally, a small radial hole that extends through the wall of tube 112 forms an orifice 120 that is effective to maintain restricted communication between chamber space 108 and the interior of tube 112 when diaphragm 56 is seated closed on valve seat 118. Thus, orifice 120 and the open area that is circumscribed by valve seat 118 constitute two parallel branches for flow through the LDP module. Because orifice 120 is always open, one of the two branches is always open. The other branch is under the control of valve 38 which functions to selectively allow and disallow flow through the other branch.

At times other than during performance of a leak detection test, the evaporative emission space of the engine's fuel supply system is freely vented to atmosphere through canister 20, assembly 26, valve 38, and filter 40. The evaporative emission space of the fuel supply system comprises the headspace of fuel tank 14, canister 20, and any spaces, such as associated conduits, that are in communication therewith. CPS valve 18 is operated by ECM 12 to periodically purge vapors from canister 20 and the tank headspace to engine 10. The exact scheduling of such purging is typically controlled by the vehicle manufacturer's requirements.

Preparatory to a more detailed description of leak detection system 22, it is believed appropriate to describe in a general way how the leak detection system performs a leak detection test on the evaporative emission system.

A leak detection test on the evaporative emission system is commenced by ECM 12 1) signaling CPS valve 18 to be closed and 2) then signaling test circuit 34 to perform the test. A representative test may comprise an initial test phase for determining the presence of a "pinched line"; in the absence of detecting a "pinched line", the test enters into the leak detection test phase.

Upon ECM 12 signaling test circuit 34 to perform a test, circuit 34 begins passing pre-heating current through thermistor 32. A timing function is also commenced by a timing circuit portion of circuit 34. After thermistor 32 has been pre-heated to a point where it draws a stable current, test circuit 34 causes pump 24 to operate and begin building superatmospheric pressure in the evaporative emission space under test. Naturally all closures, such as the vehicle tank filler cap, must be in place to close the evaporative emission system under test. At this time air is freely sucked through filter 40 and valve 38 because tube 112 is open.

Test circuit 34 has means defining a first time marker that represents a predetermined minimum allowable time for the evaporative emission system to be pressurized to a predetermined superatmospheric target pressure. If this predetermined target pressure is attained before the timing function reaches the first time marker, a "pinched line" would be indicated, and the ensuing leak detection test aborted.

Test circuit 34 also has means defining a second time marker that represents a predetermined maximum allowable time for the evaporative emission system to be pressurized to the predetermined superatmospheric target pressure. If this predetermined target pressure is not attained before the timing function reaches the second time marker, a malfunction in the leak detection system or a "gross leak" in the evaporative emission system would be indicated, and the ensuing leak detection test aborted.

These first and second time markers may be generally considered to define a window of time within which the target pressure must be attained, or else the remainder of the test aborted. These markers are predefined by taking into account the sizes of the various fuel storage system components and various possible liquid fuel levels in the fuel tank. If neither a "pinched line", leak detection system malfunction, nor a "gross leak" is detected, the leak detection test phase proceeds to measure the size of the leakage, if any.

Assuming that the test is allowed to continue, pump 24 will have pressurized the evaporative emission system to the predefined superatmospheric target pressure within the allotted time window. During system pressurizing, the air that is being pumped by pump 24 into the system is constrained to flow through flowmeter 28, passing over thermistor 32 as it flows through channel 31. At the same time, the pump outlet pressure is being fed back to valve 38. Upon the pressure in the evaporative emission system reaching the target pressure, the pressure feedback to chamber space 106 of valve 38 has developed a force acting on the diaphragm in opposition to the force of spring 114 sufficient to cause the central diaphragm region 116 to be seated closed on seat 118. With valve 38 so closed, atmospheric air can be drawn by pump 24 only through orifice 120.

If there is no leakage from the evaporative emission system, no additional air can be pumped through channel 31 and into the evaporative emission system, and consequently, there can be no flow across thermistor 32.

On the other hand, if there is some leakage from the evaporative emission system, pump 24 will make up the loss by striving to maintain pressure at the predefined target pressure, but it can do so only by drawing atmospheric air through orifice 120. Orifice 120 is sized to allow non-restrictive flow through itself when valve 38 is closed, given the expected range of leakage that is to be measured. By providing orifice 120 in conjunction with valve 38, instead of eliminating the valve and leaving a sufficiently large area open at all times for the inlet flow to the pump, a beneficial damping is provided that renders the module less sensitive to extraneous disturbances that may occur during a test.

Because of the known temperature vs. current characteristic of thermistor 32, the current flow through the thermistor is indicative of the rate of flow through channel 31, and hence indicative of leakage from the evaporative emission system under test. Because of these various relationships involved, the measurement provided by thermistor 32 equates to the size of the leak, which may be expressed as the diameter of a circle of the same area as that of the leak. This measurement may be used to distinguish between compliance and non-compliance of the evaporative emission system with any relevant leakage standard or regulation.

Figure 5A:
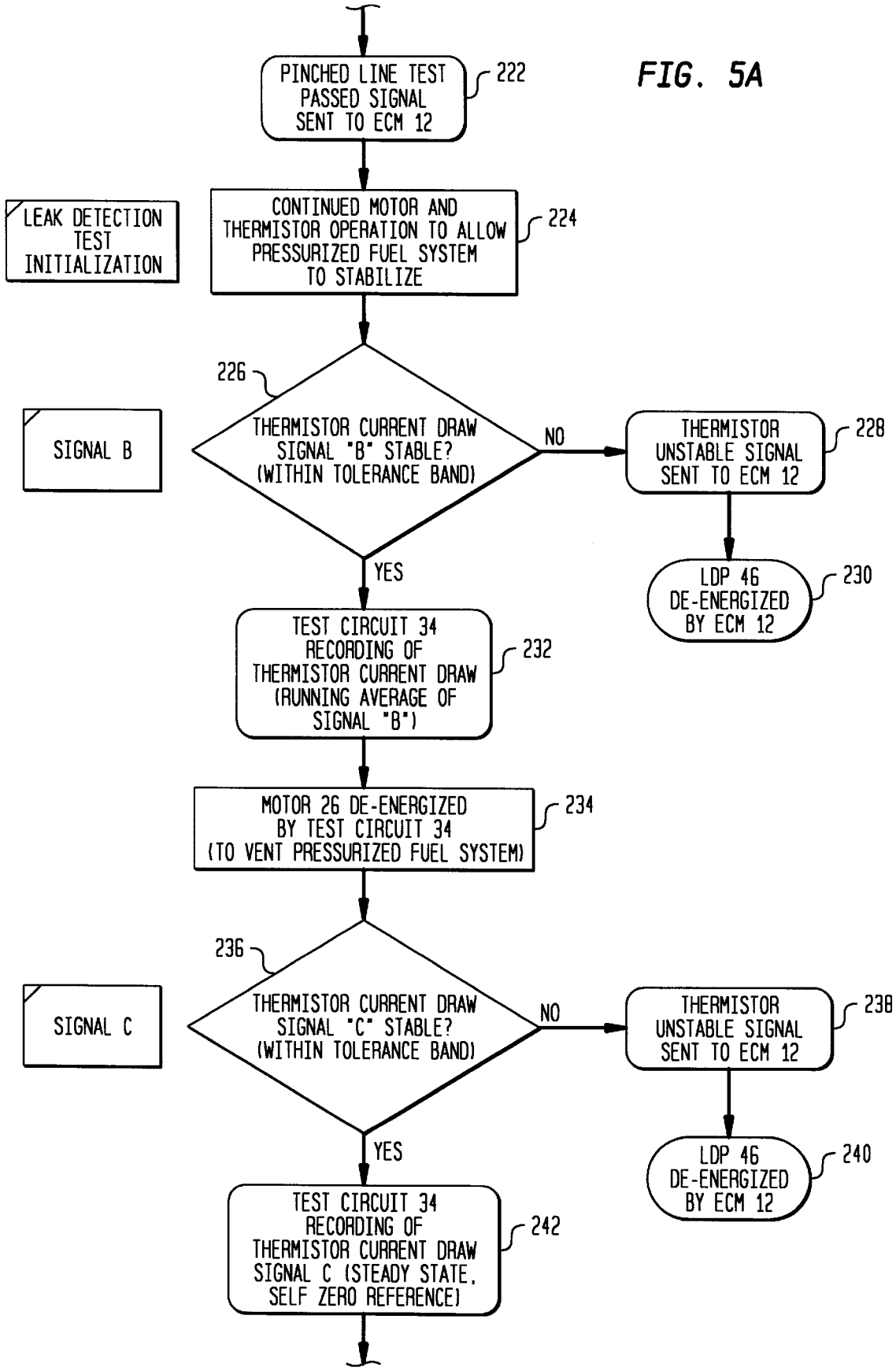
Figure 5B:
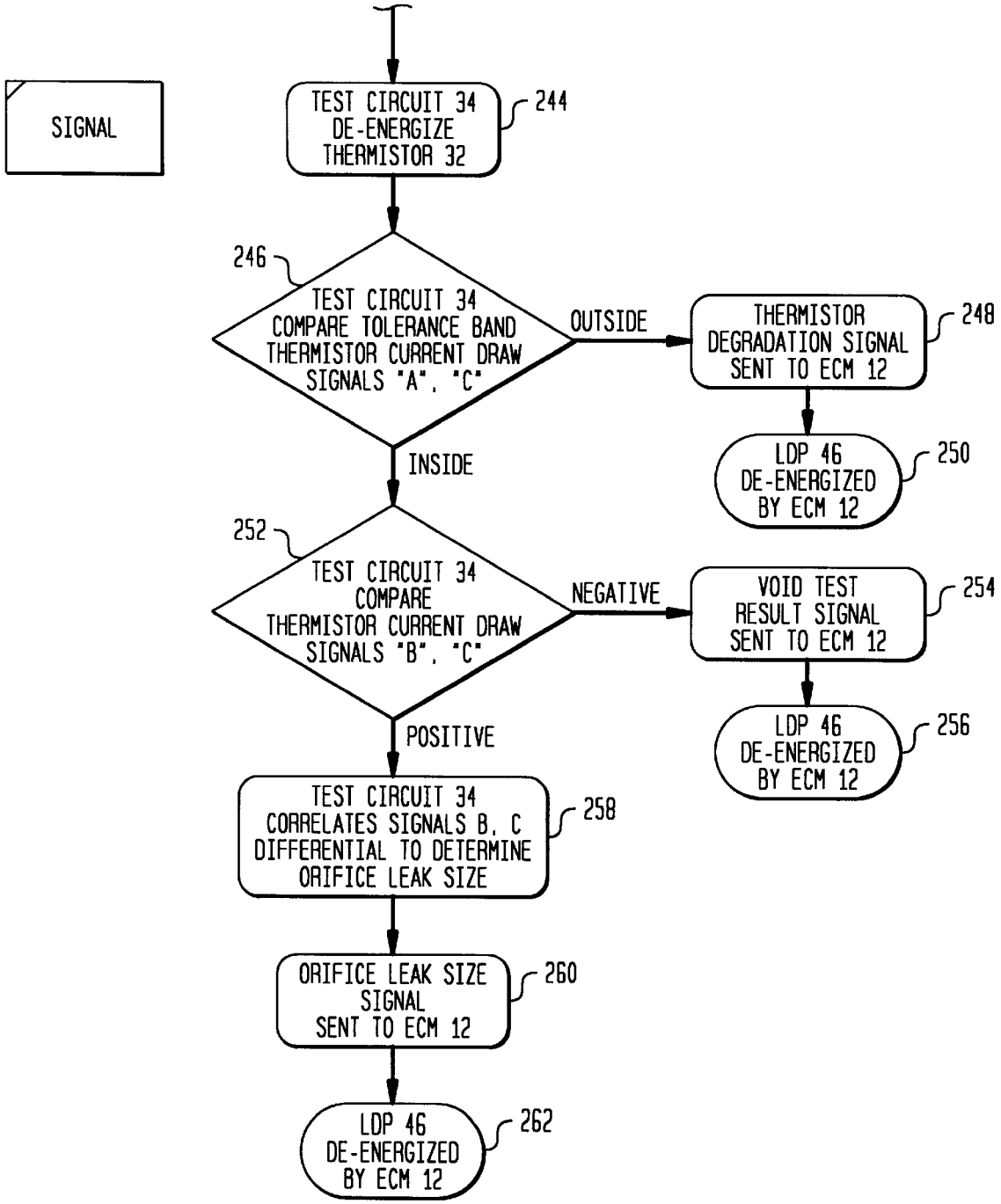
Figure 6:
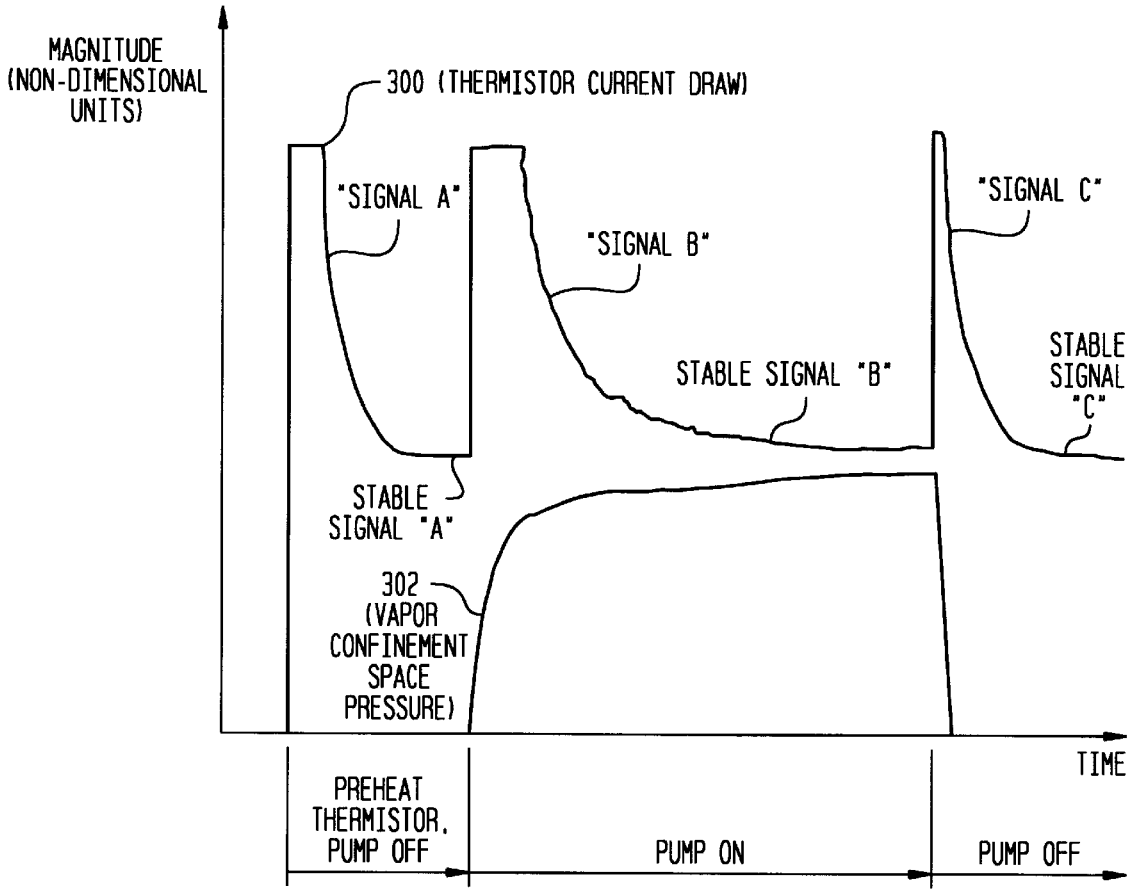
FIG. 6 comprises graph plots correlated to the flow diagram of FIGS. 5, 5A, and 5B.

A general description having been presented, a test can now be explained in more specific detail with reference to FIGS. 5, 5A, and 5B, and FIG. 6. Test circuit 34, in conjunction with ECM 12, executes an algorithm defining the specific sequence of steps to be performed during a leak detection test, and such an algorithm is represented by the flow diagram of FIGS. 5, 5A, and 5B. FIG. 6 depicts thermistor current draw and system pressure as functions of time during a test that proceeds to completion without abortion. The reference numeral 300 designates a representative graph plot of thermistor current draw, and the reference numeral 302 designates a representative graph plot of pump outlet pressure, which is substantially equal to the pressure in the evaporative emission system under test.

FIG. 5 depicts an initial step 200 that comprises ECM 12 sending a signal to test circuit 34 to commence a test. In response to receipt of this signal, a portion of test circuit 34 initiates a timing function, and another portion begins preheating thermistor 32 (step 202). Pump 24 is not operated by motor 26 at this time. The electric current drawn by thermistor 32 creates a thermal energy input to the thermistor which, if the thermistor is operating properly, will eventually result in a substantially stable current being drawn. The initial portion of the graph plot 300 of FIG. 6 depicts, as "Signal A", the thermistor current draw and its stabilization at a level designated stable Signal "A".

FIG. 5 shows that step 204 of the algorithm tests for stability of signal "A". Had stability not been not detected, then a "Thermistor Unstable" signal would have been sent from test circuit 34 to ECM 12 (step 206), and the ECM in turn would have de-energized LDP module 46 by shutting down electric power to test circuit 34 thereby aborting the test (step 208). This "Thermistor Unstable" signal may be recorded in ECM 12 for reference.

Upon attainment of thermistor current draw stability, the value of Stable Signal "A" is recorded by test circuit 34 as a reference (step 210).

Having detected and recorded a signal of thermistor stability, test circuit 34 now proceeds to perform the "pinched line" test phase. Step 212 shows that test circuit 34 begins to perform this phase by causing motor 26 to be energized to operate pump 24. Air is now forced to flow through channel 31, passing across thermistor 32 in the process. The rate of heat transfer from the thermistor quickly increases due to the cooling effect of the passing airflow. Additional current is therefore drawn by the thermistor, as shown by graph plot 300 in FIG. 6. A portion of test circuit 34 now begins to average the thermistor current draw (step 214). The pressure at the outlet of the pump will begin to build toward a predefined target value, and the average current draw by thermistor 32 will begin to diminish as the target pressure is approached. This can be seen by comparing graph plots 300 and 302 in FIG. 6. If the average current draw decreases to a level that corresponds to the target pressure before the timing function reaches the first time marker, a "pinched line" is indicated (step 216). A "pinched line" signal is sent to ECM 12, and recorded (step 218). ECM 12 shuts off power to test circuit 34 thereby aborting the test (step 220).

On the other hand, if the average thermistor current draw has not decreased to a level that corresponds to the target pressure by the time that the timing function reaches the first time marker, a "pinched line test passed" signal is indicated (step 216), and a "pinched line test passed" signal is sent to ECM 12 and recorded (step 222 in FIG. 5A), and the test continues (step 224).

Test circuit 34 comprises means for taking a running average of the thermistor current draw and means defining a tolerance band with which that running average is compared. Step 226 tests for stability of that running average within that tolerance band. Failure of the average current draw to attain stability within the band by the time that the timing function has elapsed to the second time marker, indicates a problem which could be due to a malfunction in test circuit 34, including thermistor 32, and/or a "gross leak" in the evaporative emission system under test. Step 224 shows that test circuit 34 takes a running average of the thermistor current draw, which is referred to as Signal "B". If step 226 reveals that the averaged thermistor current draw has failed to reach a level within the tolerance band by the second time marker, a "fault" signal is given to ECM 12 (step 228) and recorded, and ECM 12 signals back to abort the test (step 230).

On the other hand, if the averaged thermistor current draw stabilizes within the tolerance band when the second time marker occurs, the test continues with the current running average within the tolerance band being designated as stable Signal "B", and recorded by test circuit 34 (step 232). After the stable signal "B" has been recorded, circuit 34 de-energizes motor 26 (step 234) to terminate operation of pump 24. The recorded stable Signal "B" is representative of the flow through channel 31. Because of the known relationships described earlier, this recorded stable Signal "B" is also representative of leakage from the evaporative emission system.

After pump 24 has stopped, the pressurized evaporative emission space vents through the pump to atmosphere via orifice 120 of LDP module 46. Consequently, the pressure in the evaporative emission space begins to dissipate, slowly at first due to the effect of orifice 120, but then more rapidly once the diminishing pressure feedback provided to valve 38 has fallen slightly below the target pressure to cause the valve to re-open. This venting creates a reverse flow through channel 31 and results in increased current draw by thermistor 32 until the pressure in the evaporative emission space has returned to atmospheric pressure. Thereupon the current draw by thermistor 32 will diminish, and should eventually stabilize, because of the cessation of flow through channel 31.

The thermistor current draw is therefore measured for stability within a tolerance band (step 236). If such stability is not detected, a "Thermistor Unstable" signal is sent from test circuit 34 to ECM 12 (step 238) where it is recorded, and ECM 12 shuts down LDP 46 to discontinue the test (step 240).

Should the averaged thermistor current draw stabilize within the tolerance band, the test continues with the current draw within the tolerance band being averaged as stable Signal "C", and recorded by test circuit 34 for use as a self-zeroing reference (step 242) for the test circuit. Circuit 34 then discontinues current through thermistor 32 (step 244).

The remainder of the test involves a calculation of the effective leak size. Step 246 shows that circuit 34 compares the recorded stable Signal "A" and the recorded stable Signal "C". These signal values must not differ by more than a predefined amount, or else degradation of a portion of test circuit 34 and/or thermistor 32, is presumed, and an appropriate signal is transmitted to ECM 12 where it is recorded (step 248). ECM 12 then shuts down LDP 46 (step 250).

If the values of stable Signal "A" and stable Signal "C" do not differ by more than the predefined amount, then the recorded stable Signal "B" and the recorded stable Signal "C" are compared (step 252). If the value of stable Signal "C" is found to exceed that of stable Signal "B", the test would be deemed faulty, and the test result voided by sending an appropriate signal to ECM 12 (step 254). ECM then shuts down LDP 46 (step 256).

If the value of stable Signal "C" is found not to exceed that of stable Signal "B", the test would not be deemed faulty, and the difference between them would indicate the size of leakage from the evaporative emission space (step 258). The leak size measurement is then transmitted to ECM 12 where it is recorded (step 260). The test finally concludes by ECM 12 shutting down LDP 46 (step 262).

Usage of any of the test results is typically determined by the vehicle manufacturer. Any result may be used immediately to signal the vehicle operator, or it may be extracted by a service technician at time of vehicle service.

The recorded leak size measurement can be compared with any relevant leakage standard or regulation to determine compliance and/or non-compliance of the evaporative emission system.

Figure 7:
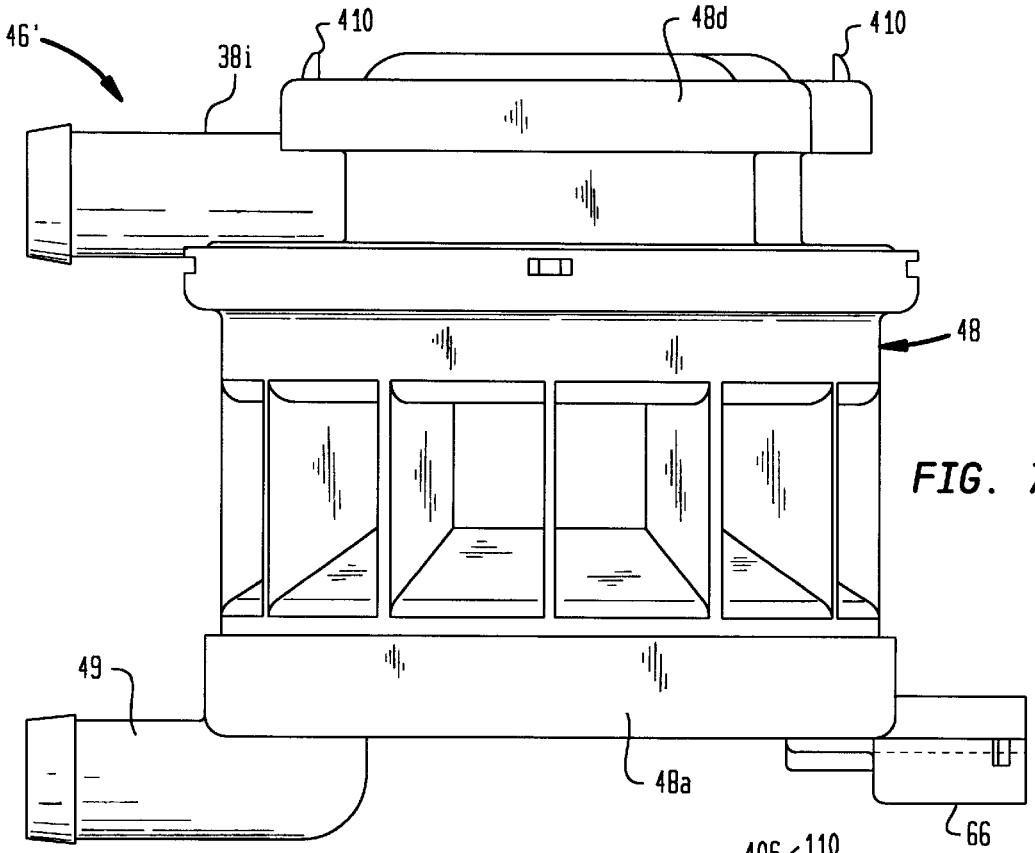
FIG. 7 is an external longitudinal view of another embodiment.
Figure 8:
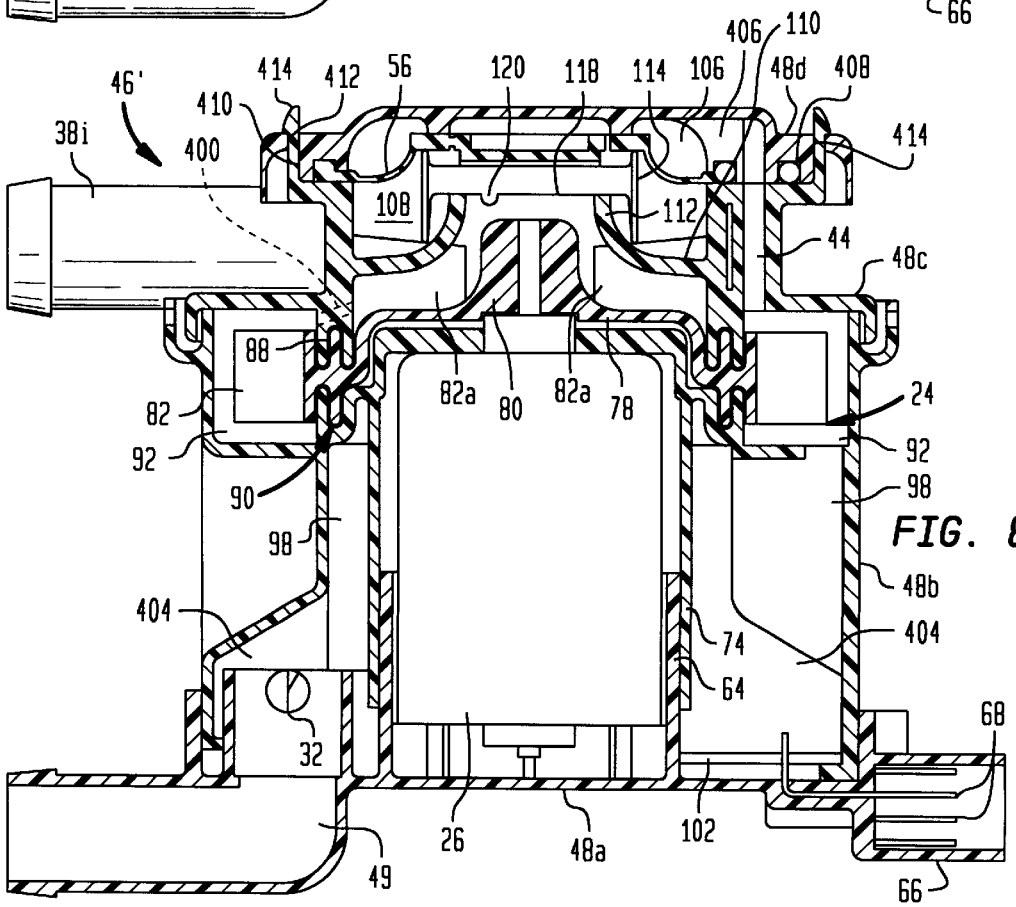
FIG. 8 is a longitudinal cross section view of FIG. 7 on a larger scale.

FIGS. 7 and 8 disclose a second embodiment of LDP module 46' in which parts corresponding to parts of the first embodiment 46 are identified by like reference numerals. While both embodiments share generic principles, there are several construction differences. For one, impeller 78 is a two-stage, rather than a single stage impeller. FIG. 8 shows that proximally adjacent hub 80, the impeller comprises series of circumferentially spaced apart blades, or vanes, 82*a*. There is no separate impeller cap 54, as in the first embodiment. Rather, walls 110, 112 are re-shaped to have a bell-mouth, or horn-shaped, form that expands radially in an axial direction away from valve seat 118. Each blade 82*a* has an edge that conforms to the contour of the bell-mouth, but with slight clearance.

At a particular location around its circumferential extent and vertically above groove 88 as viewed in FIG. 8, wall 110 contains a passage 400 that serves to communicate the high pressure side of the first stage with the low pressure side of the second stage. The second stage, which comprises vanes 82, is essentially the same as in the first embodiment. It is circumferentially divided into a low pressure, or inlet, zone and a high-pressure, or outlet, zone. The high-pressure outlet zone continues to be identified by the reference numeral 92, but rather than delivering air from pump 24 directly into tubular wall 30 as in the first embodiment, it is separated from the flowmeter by the space 98 surrounding the motor mounting.

By comparing FIGS. 2 and 8, it can been seen that space 98 has a different shape in each embodiment due to different constructions of their respective side walls. Outlet 24*o*, which cannot be seen in the view of FIG. 8, communicates directly to space 98. Space 98 extends axially away from outlet 240 (downwardly as viewed in FIG. 8) as a channel that flares radially outwardly at its opposite axial end, the flared region being identified by the reference numeral 404. The inner end of tube 49 is open to space 98 in this flared region, and the body of thermistor 32 is disposed within the inner end portion of tube 49.

Thus, LDP module 46' has the flowmeter integrated into the outlet tube, rather than having a separate additional walled tube 30, as in the first embodiment. As was the case for the first embodiment, the entire flow from pump 24 is likewise constrained to pass through the flowmeter of LDP module 46'. The exit end portion of tube 49 is in the shape of an elbow, and the connector shell 66 opens radially, illustrating how the housing adapter part 48*a* can be adapted to a particular vehicle while other components of the LDP module can be common to modules having different housing adapter parts. Circuit board 102 is constructed to fit into housing adapter part 48*a* and to provide for the body of thermistor 32 to be disposed internally of tube 49. If the thermistor leads extend through an opening in the wall of tube 49, they are suitably sealed with respect to the wall.

In LDP module 46', the pump outlet pressure feedback to valve 38 is via an internal passage, rather than an external one. Housing parts 48*c* and 48*d* are designed to form conduit 44 by incorporating respective portions of the conduit as internal passages. The portion of conduit 44 in housing part 48*c* is an axially extending through-hole, just inward of the exterior of the part's sidewall, having one end open to space 92 and the opposite end open to the part's surface that confronts housing part 48*d*. The portion of conduit 44 in part 48*d* forms a continuation of the through-hole in part 48*c* that leads to a small alcove 406 that is open to chamber space 106. An O-ring 408, that joins in coalesence with the perimeter of diaphragm 56, forms a gas-tight seal around the conduit at the joint between the two housing parts 48*c*, 48*d*.

LDP 46' also has a convenient means of attaching the two housing parts 48*c*, 48*d*. Part 48*c* has several catches 410 that project axially from various locations around its rim that is proximate the rim of housing part 48*d*. The latter has corresponding slots 412 through which catches 410 pass when the two parts are being assembled together by axially aligning them and then advancing them toward each other. During this assembly process, the barbed end 414 of each catch 410 is initially engaged by an edge portion of the corresponding slot 412 and then slightly resiliently deflected. After the slots have cleared the barbs, they relax slightly to bring the barbs into interference with the slots' margins, thereby joining the two housing parts. The margin of diaphragm 56 is thereby captured in a sealed manner between the two housing parts, and O-ring 408 is placed in sealing relation around conduit 44 at the joint between the two housing parts.

Orifice 120 is provided as a notch at a circumferential location in the rim of seat surface 118. This notch can be conveniently incorporated into part 48*c* during the process of fabricating the part, such as by injection molding. Even though valve 38 may close the open area of seat surface 118, orifice 120 remains open.

Figure 9:
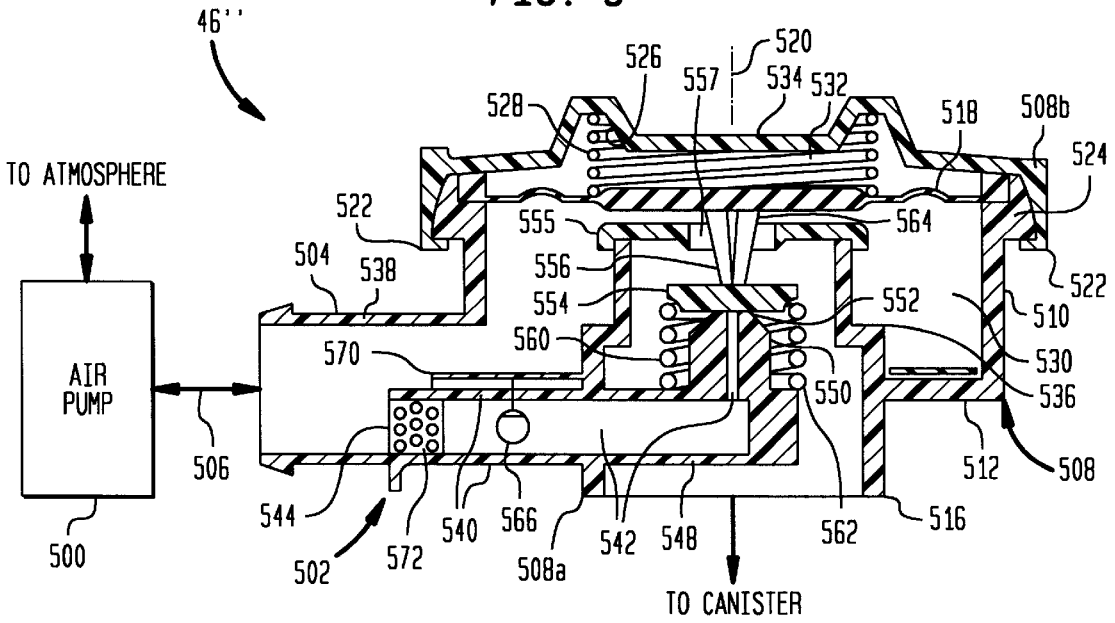
FIG. 9 is a view of a further embodiment showing one component schematically and another in longitudinal cross section.

FIG. 9 shows another embodiment 46" that possesses generic aspects of the first two embodiments, but is rather different in certain of its specific details. A pump 500 is shown remotely located from an assembly 502. The pump outlet and an inlet port 504 of assembly 502 are communicated by a conduit 506. Pump 500 can be any suitable form of pump that is equivalent to pump 24 of LDP modules 46, 46'. It may even be an off-the-shelf item.

Assembly 502 incorporates the functions described in detail above in connection with LDP module 46, but with a rather different construction. Assembly 502 comprises a housing 508 composed of two housing parts 508*a* and 508*b*. Part 508*a* functions as a housing adapter part, like part 48*a*. It comprises a generally cylindrical side wall 510, and an axial end wall 512, and is open at the axial end opposite end wall 512. In addition to inlet port 504, part 508*a* also comprises a second port 516. Port 516 serves to place assembly 502 in communication with the canister vent port, either directly, or via an interconnecting conduit.

Housing part 508*b* cooperates with the open axial end of part 508*a* to capture the outer peripheral margin of a diaphragm 518 between them, forming a gas-tight joint. Housing parts 508*a*, 508*b* are coaxially arranged along a main longitudinal axis 520 of assembly 502 and are generally cylindrically shaped. The attachment at the joint between the two housing parts comprises catches 522 around the perimeter of part 508*b* that snap onto the outside of a rim 524 extending around the open end of part 508*a*.

Housing part 508*b* has a circular seating groove 526 for one axial end of a helical coil compression spring 528. The opposite end of spring 528 bears against diaphragm 518 for biasing the central region of the diaphragm axially away from groove 526.

Diaphragm 518 divides the interior of housing 508 into chamber spaces 530, 532. Spring 528 is disposed within the latter chamber space. Chamber space 532 is also communicated to atmospheric pressure via a hole 534 so that the pressure therein is at atmospheric pressure.

Radially inward of side wall 510, part 508*a* further comprises a stepped cylindrical wall 536 that is coaxial with axis 520. Wall 536 may be viewed as comprising an extension of the wall of port 516 into the housing interior.

Port 504 comprises an outer tubular wall 538 which merges both with a portion of the housing side wall and with a portion of the wall of port 516. The portion of wall 538 that merges with the wall of port 516 forms a portion of a smaller tubular wall 540 that extends radial to axis 520 within outer tubular wall 538. The axis of tubular wall 540 is non-coaxial with the axis of wall 538. Tubular wall 540 provides a flowpath 542 that has one end opening 544 that is spaced inwardly of the free axial end of outer wall 538. Flowpath 542 passes through a portion of the wall of port 516 and continues therein as a tubular wall 548 that stops short of the diametrically opposite portion of the wall of port 516. Wall 548 includes a formation 550 that extends radially of the wall's own axis, coaxial with axis 520. The free end of formation 550 is tapered to provide a valve seat 552 with which a valve element 554 is associated. Flowpath 542 continues from the interior of wall 548 through formation 550 to valve seat 552.

An annular valve seat member 555, comprising an annular valve seat 556 circumscribing a central hole 557, is disposed on the free end of wall 536 coaxial with axis 520. Valve element 554 is shown as a disk in a position axially between the two valve seats 552 and 556. At its margin, disk 554 has a shoulder that serves as a seat for one axial end of a helical coil compression spring 560. The opposite axial end of spring 560 seats on a seat surface 562 surrounding the base of formation 550 on wall 548.

FIG. 9 shows a condition wherein disk 554 is seated closed on seat 552, leaving hole 557 open. This is the condition that occurs when there is no pressure differential acting on diaphragm 518. Disk 554 is operatively associated with diaphragm 518 via a post 564 that extends centrally from the diaphragm to the disk along axis 520 so that the disk moves in unison with the central region of the diaphragm.

The body of a thermistor 566 is disposed within flowpath 542. Its leads extend through wall 540 in a sealed manner to a circuit board 570 that is disposed on the interior of end wall 512 of housing part 508*a*. A particulate filter element 572 is disposed across flowpath 542 internally of wall 540 upstream of the thermistor body relative to the direction of air pumped by pump 500. The vapor confinement space of the evaporative emission control system is vented to atmosphere when assembly 502 is in the condition shown in FIG. 9 and pump 500 is not running.

A leak detection system embodying LDP 46" performs a leak detection test in analogous manner to that described earlier according to the algorithm represented by the flow diagrams of FIGS. 5, 5A, and 5B. Thermistor 566 is preheated until it draws a stable current. If a stable current draw is not attained, the test is aborted. Assuming that stable current draw is attained, then pump 500 begins to run. The pumped air enters port 504 where initially it passes entirely into chamber space 530, and thence through hole 557 and along the interior of cylindrical wall 536, to finally exit through port 516. As pressure begins to build, the differential across diaphragm 518 causes the central diaphragm region to move toward chamber space 532 against the opposing force of spring 528. This movement enables spring 560 to unseat valve disk 554 from seat 552, thereby opening flowpath 542.

The pumped air entering inlet port 504 now divides into two branches as it passes through the nipple that forms the port. A majority of the flow continues along the initial path that was just described. A minority of the flow now passes through flowpath 542. The split paths entrain within the interior of cylindrical wall 536 to pass ultimately into the vapor confinement space of the evaporative emission control system.

Pressure in the vapor confinement space continues to build toward a predefined superatmospheric target pressure. When that pressure has been reached, the central region of diaphragm 518 will have been displaced sufficiently away from valve seat member 555 to have enabled spring 560 to have seated valve element 554 on seat 556. This closes the majority flowpath through assembly 502, leaving only the minority flowpath open. Since this minority flowpath contains the body of thermistor 566, the thermistor and its related circuit can now measure the leakage flow in the same manner as described earlier for the other embodiments in connection with the disclosed test algorithm.

Assuming that the thermistor current draw stabilizes at some level within the corresponding band, the stabilized signal is recorded, and pump 500 is shut off. Initially the pressurized vapor confinement space can vent only through the minority flowpath. But upon the pressure dropping slightly below the target pressure, the reduced pressure differential across diaphragm 518 will enable spring 528 to begin forcing the central diaphragm region toward valve seat member 555, thereby unseating valve member 554 from seat 556. This now re-opens the majority flowpath so that the pressure is more quickly vented to atmosphere. The current draw by thermistor 566 is monitored for stability, and upon attainment of same, the final calculational steps of the test algorithm are performed.

The various embodiments that have been disclosed herein can be fabricated by conventional manufacturing and assembly processes. The housing parts and impeller are preferably molded from suitable fuel-resistant plastic materials. Motor 26 is a conventional DC electric motor. Conventional engineering modeling and computational techniques are employed to provide for proper flow rates and valve operation. The electric circuitry employed can be fabricated with conventional circuit components. If a devoted processor is incorporated in the test circuit, it can be programmed according to known procedures to embody the algorithm that has been described.

While a presently preferred embodiment of the invention has been illustrated and described, it is to be appreciated that the principles may be practiced in other equivalent ways within the scope of the following claims.

We claim:

1. In an automotive vehicle having an engine for powering the vehicle, a fuel tank for storing volatile fuel that is to be combusted in combustion chamber space of the engine, and an evaporative emission control system comprising a vapor confinement space for confining volatile fuel vapor and a canister purge valve that is periodically operated to purge vapor from the vapor confinement space to the engine for entrainment with combustible mixture that is to be combusted in the engine combustion chamber space, and a leak detection system operatively associated with the evaporative emission control system for detecting leakage from a portion of the vapor confinement space which is upstream of an inlet of the canister purge valve relative to the engine, the improvement in said leak detection system which comprises:

a pump for pumping a gaseous medium;

a flowpath providing communication between the pump and the vapor confinement space;

a flowmeter for measuring flow of gaseous medium through the flowpath;

the flowmeter comprising an electric circuit element disposed in the flowpath to be exposed to flow of gaseous medium through the flowpath;

the electric circuit element having a predetermined temperature vs. electric current characteristic that enables the electric circuit element to provide a signal correlated to flow of gaseous medium through the flowpath; and an electric circuit to which the electric circuit element is operatively connected for supplying electric current to the electric circuit element and for creating a signal representative of electric current flow through the electric circuit element, and hence of flow of gaseous medium through the flowpath;

in which the flowpath comprises a tubular wall through which the flow of gaseous medium passes, and the thermistor comprises a body which is disposed internally of the tubular wall;

said electric circuit element comprises a thermistor; and the electric circuit and the thermistor form an assembly, the electric circuit is disposed externally of the tubular wall, and leads extend from the electric circuit to the body of the thermistor.

2. The leak detection system set forth in claim 1 in which the tubular wall has an axial end opening through which the flow of gaseous medium passes, and the leads extend from the electric circuit to the thermistor body by passing through the axial end opening of the tubular wall.

3. The leak detection system set forth in claim 2 in which the gaseous medium is atmospheric air, and the pump is arranged to pump atmospheric air into the vapor confinement space to create superatmospheric pressure in the vapor confinement space.

4. The leak detection system set forth in claim 3 in which the pump comprises an impeller that is operated by an electric motor.

5. In an automotive vehicle having an engine for powering the vehicle, a fuel tank for storing volatile fuel that is to be combusted in combustion chamber space of the engine, and an evaporative emission control system comprising a vapor confinement space for confining volatile fuel vapor and a canister purge valve that is periodically operated to purge vapor from the vapor confinement space to the engine for entrainment with combustible mixture that is to be combusted in the engine combustion chamber space, and a leak detection system operatively associated with the evaporative emission control system for detecting leakage from a portion of the vapor confinement space which is upstream of an inlet of the canister purge valve relative to the engine, the improvement in said leak detection system which comprises:

a pump for pumping a gaseous medium;

a flowpath providing communication between the pump and the vapor confinement space;

a flowmeter for measuring flow of gaseous medium through the flowpath;

the flowmeter comprising an electric circuit element disposed in the flowpath to be exposed to flow of gaseous medium through the flowpath;

the electric circuit element having a predetermined temperature vs. electric current characteristic that enables the electric circuit element to provide a signal correlated to flow of gaseous medium through the flowpath; and an electric circuit to which the electric circuit element is operatively connected for supplying electric current to the electric circuit element and for creating a signal representative of electric current flow through the electric circuit element, and hence of flow of gaseous medium through the flowpath;

in which the pump comprises an outlet communicated via the flowpath to the vapor confinement space and an inlet that is selectively communicated to atmosphere via a valve, means causing the valve to be open while the pump operates to pressurize the vapor confinement space to a predetermined superatmospheric pressure, and means causing the valve to be closed when the pressure in the vapor confinement space is at the predetermined superatmospheric pressure.

6. The leak detection system set forth in claim 5 including an orifice disposed in parallel with the valve to maintain communication of the pump inlet to atmosphere when the valve is closed, and wherein the orifice has an effective flow area smaller than the effective flow area of the valve when the valve is open.

7. The improvement set forth in claim 1 wherein a housing containing the flowmeter is disposed in the flowpath, and the housing is constructed and arranged such that the entire flow through the flowpath flows through the flowmeter.

8. In an automotive vehicle having an engine for powering the vehicle, a fuel tank for storing volatile fuel that is to be combusted in combustion chamber space of the engine, and an evaporative emission control system comprising a vapor confinement space for confining volatile fuel vapor and a canister purge valve that is periodically operated to purge vapor from the vapor confinement space to the engine for entrainment with combustible mixture that is to be combusted in the engine combustion chamber space, and a leak detection system operatively associated with the evaporative emission control system for detecting leakage from a portion of the vapor confinement space which is upstream of an inlet of the canister purge valve relative to the engine, the improvement in said leak detection system which comprises:

a pump for pumping a gaseous medium;

a flowpath providing communication between the pump and the vapor confinement space;

a flowmeter for measuring flow of gaseous medium through the flowpath;

the flowmeter comprising an electric circuit element disposed in the flowpath to be exposed to flow of gaseous medium through the flowpath;

the electric circuit element having a predetermined temperature vs. electric current characteristic that enables the electric circuit element to provide a signal correlated to flow of gaseous medium through the flowpath; and an electric circuit to which the electric circuit element is operatively connected for supplying electric current to the electric circuit element and for creating a signal representative of electric current flow through the electric circuit element, and hence of flow of gaseous medium through the flowpath;

wherein a housing containing the flowmeter is disposed in the flowpath, and the housing is constructed and arranged such as to provide two flow branches, one of which contains the flowmeter, and the other of which contains a valve for allowing and disallowing flow through the other branch.

9. The improvement set forth in claim 1 including an engine controller that is in electric communication with the electric circuit, and that exercises supervisory control over operation of the electric circuit and the pump in accordance with an algorithm.

10. The leak detection system set forth in claim 9 in which the algorithm comprises a basic test algorithm that is contained in the electric circuit, and that is supervised by the engine controller.

11. The leak detection system set forth in claim 9 in which the algorithm comprises means for causing the electric circuit to detect a first state of stability of electric current flow through the electric circuit element while the pump is running, means for causing the electric circuit to detect a second state of stability of electric current flow through the electric circuit element while the pump is not running, and means for causing the electric circuit to process a value of the first state of stability of electric current flow through the electric circuit element and a value of the second state of stability of electric current flow through the electric circuit element to ascertain the existence of any leakage from the vapor confinement space.

12. The leak detection system set forth in claim 11 in which the means for causing the electric circuit to process a value of the first state of stability of electric current flow through the electric circuit element and a value of the second state of stability of electric current flow through the electric circuit element comprises means for comparing one to the other, and the algorithm comprises means for causing the result of the comparison to be recorded by the engine controller.

13. The leak detection system set forth in claim 11 in which the algorithm causes detection of the first state of stability of electric current flow through the electric circuit element while the pump is running to occur prior in time to causing detection of the second state of stability of electric current flow through the electric circuit element while the pump is not running.

14. The leak detection system set forth in claim 9 in which the algorithm comprises means for causing the electric circuit to detect a first state of stability of electric current flow through the electric circuit element while the pump is running, means for thereafter causing the electric circuit to detect a second state of stability of electric current flow through the electric circuit element while the pump is not running, and means for causing the electric circuit to detect, prior in time to detecting the first state of stability of electric current flow through the electric circuit element while the pump is running, an initial state of stability of electric current flow through the electric circuit element while the pump is not running.

15. The leak detection system set forth in claim 14 in which the algorithm comprises means for causing the electric circuit to process a value of the initial state of stability of electric current flow through the electric circuit element and a value of the second state of stability of electric current flow through the electric circuit element to detect any difference between them that is indicative of change in accuracy of a portion of the electric circuit that includes the electric circuit element.

16. The leak detection system set forth in claim 15 in which the algorithm comprises means for invalidating a leak detection test if the electric circuit detects more than a predetermined difference between the value of the initial state of stability of electric current flow through the electric circuit element and the value of the second state of stability of electric current flow through the electric circuit element.

17. The leak detection system set forth in claim 16 in which the algorithm comprises means for causing the detection of more than a predetermined difference between the value of the initial state of stability of electric current flow through the electric circuit element and the value of the second state of stability of electric current flow through the electric circuit element to be recorded by the engine controller.

18. The leak detection system set forth in claim 16 in which the algorithm comprises means for causing the electric circuit to process the value of the first state of stability of electric current flow through the electric circuit element and of the value of the second state of stability of electric current flow through the electric circuit element to ascertain any leakage from the vapor confinement space if the electric circuit detects less than the predetermined difference between the value of the initial state of stability of electric current flow through the electric circuit element and the value of the second state of stability of electric current flow through the electric circuit element.

19. The leak detection system set forth in claim 18 in which the algorithm comprises means for causing a result of the evaluation of the value of the first state of stability of electric current flow through the electric circuit element and of the value of the second state of stability of electric current flow through the electric circuit element to be recorded by the engine controller.

20. In an automotive vehicle having an engine for powering the vehicle, a fuel tank for storing volatile fuel that is to be combusted in combustion chamber space of the engine, and an evaporative emission control system comprising a vapor confinement space for confining volatile fuel vapor and a canister purge valve that is periodically operated to purge vapor from the vapor confinement space to the engine for entrainment with combustible mixture that is to be combusted in the engine combustion chamber space, and a leak detection system operatively associated with the evaporative emission control system for detecting leakage from a portion of the vapor confinement space which is upstream of an inlet of the canister purge valve relative to the engine, the leak detection system comprising:

a pump for pumping a gaseous medium;

a flowpath providing communication between the pump and the vapor confinement space;

a flowmeter for measuring flow of gaseous medium through the flowpath; and in which the pump comprises an outlet communicated via the flowpath to the vapor confinement space and an inlet that is selectively communicated to atmosphere via a valve, means causing the valve to be open while the pump operates to pressurize the vapor confinement space to a predetermined superatmospheric pressure, and means causing the valve to be closed when the pressure in the vapor confinement space is at the predetermined superatmospheric pressure.

21. The leak detection system set forth in claim 20 including an orifice disposed in parallel with the valve to maintain communication of the pump inlet to atmosphere when the valve is closed, and wherein the orifice has an effective flow area smaller than the effective flow area of the valve when the valve is open.

22. The leak detection system set forth in claim 20 including an electric circuit for selectively operating the pump and for processing the gaseous flow measurement of the flowmeter in accordance with an algorithm that comprises means for causing the electric circuit to detect a first state of stability of the gaseous flow measurement of the flowmeter while the pump is running and the valve is closed.

23. The leak detection system set forth in claim 22 in which the algorithm further comprises means for causing the electric circuit to detect a second state of stability of the gaseous flow measurement of the flowmeter while the pump is not running and the valve is open, and means for causing the electric circuit to process the value of the first state of stability of the gaseous flow measurement of the flowmeter and the value of the second state of stability of the gaseous flow measurement of the flowmeter.

24. An assembly for use in a leak detection system operatively associated with an evaporative emission control system of an engine powered automotive vehicle for detecting leakage from a portion of a vapor confinement space which is upstream of an inlet of a canister purge valve relative to an engine, the assembly comprising:

a housing comprising a first port adapted to be communicated to a pump, a second port adapted to be communicated to a vapor confinement space, and two parallel branches in that portion of the flowpath that passes through the housing;

a flowmeter for measuring flow of gaseous medium through the flowpath; and a valve for allowing and disallowing flow through one of the two branches.

25. An assembly as set forth in claim 24 wherein the housing is constructed and arranged such that the entire flow through the flowpath flows through the flowmeter.

26. An assembly as set forth in claim 25 wherein the flowmeter is disposed in the flowpath between the valve and the second-port.

27. An assembly as set forth in claim 26 wherein the other branch is always open to flow and comprises a flow area less than that of the valve when the valve is allowing flow through the one branch.

28. An assembly as set forth in claim 25 wherein the flowmeter comprises a thermistor disposed in the flowpath.

29. An assembly as set forth in claim 24 including a further valve for allowing and disallowing flow through the other of the two branches.

30. An assembly as set forth in claim 29 in which the flowmeter is disposed in the other of the two branches.

31. In an automotive vehicle having an engine for powering the vehicle, a fuel tank for storing volatile fuel that is to be combusted in combustion chamber space of the engine, and an evaporative emission control system comprising a vapor confinement space for confining volatile fuel vapor and a canister purge valve that is periodically operated to purge vapor from the vapor confinement space to the engine for entrainment with combustible mixture that is to be combusted in the engine combustion chamber space, and a leak detection system operatively associated with the evaporative emission control system for detecting leakage from a portion of the vapor confinement space which is upstream of an inlet of the canister purge valve relative to the engine, the leak detection system comprising:

a pump for pumping a gaseous medium;

a flowpath providing communication between the pump and the vapor confinement space;

a flowmeter for measuring flow of gaseous medium through the flowpath; and an electric circuit for selectively operating the pump and for processing the gaseous flow measurement of the flowmeter in accordance with an algorithm that comprises means for causing the electric circuit to detect a first state of stability of the gaseous flow measurement of the flowmeter while the pump is running, means for causing the electric circuit to detect a second state of stability of the gaseous flow measurement of the flowmeter while the pump is not running, and means for causing the electric circuit to process the value of the first state of stability of the gaseous flow measurement of the flowmeter and the value of the second state of stability of the gaseous flow measurement of the flowmeter.

32. The leak detection system set forth in claim 31 in which the means for causing the electric circuit to process the value of the first state of stability of the gaseous flow measurement of the flowmeter and the value of the second state of stability of the gaseous flow measurement of the flowmeter comprises means for comparing one to the other to ascertain the existence of any leakage from the vapor confinement space.

33. The leak detection system set forth in claim 32 in which the algorithm causes the electric circuit to detect the first state of stability of the gaseous flow measurement of the flowmeter while the pump is running to occur during a time prior to causing the electric circuit to detect the second state of stability of the gaseous flow measurement of the flowmeter while the pump is not running.

34. The leak detection system set forth in claim 31 in which the algorithm comprises means for causing the electric circuit to detect the first state of stability of the gaseous flow measurement of the flowmeter while the pump is running, means for thereafter causing the electric circuit to detect the second state of stability of the gaseous flow measurement of the flowmeter while the pump is not running, and means for causing the electric circuit to detect, prior in time to detecting the first state of stability of the gaseous flow measurement of the flowmeter while the pump is running, an initial state of stability of the gaseous flow measurement of the flowmeter while the pump is not running.

35. The leak detection system set forth in claim 34 in which the algorithm comprises means for causing the electric circuit to process a value of the initial state of stability of the gaseous flow measurement of the flowmeter and a value of the second state of stability of the gaseous flow measurement of the flowmeter to detect any difference between them that is indicative of change in accuracy of a portion of the electric circuit.

36. The leak detection system set forth in claim 35 in which the algorithm comprises means for invalidating a leak detection test if the electric circuit detects more than a predetermined difference between the value of the initial state of stability of the gaseous flow measurement of the flowmeter and the value of the second state of stability of the gaseous flow measurement of the flowmeter.

37. The leak detection system set forth in claim 35 in which the algorithm comprises means for causing the electric circuit to process the value of the first state of the gaseous flow measurement of the flowmeter and the value of the second state of stability of the gaseous flow measurement of the flowmeter to ascertain any leakage from the vapor confinement space if the electric circuit detects less than a predetermined difference between the value of the initial state of stability of the gaseous flow measurement of the flowmeter and the value of the second state of the gaseous flow measurement of the flowmeter.

38. In an automotive vehicle having an engine for powering the vehicle, a fuel tank for storing volatile fuel that is to be combusted in combustion chamber space of the engine, and an evaporative emission control system comprising a vapor confinement space for confining volatile fuel vapor and a canister purge valve that is periodically operated to purge vapor from the vapor confinement space to the engine for entrainment with combustible mixture that is to be combusted in the engine combustion chamber space, and a leak detection system operatively associated with the evaporative emission control system for performing a leakage detection test for detecting leakage from a portion of the vapor confinement space which is upstream of an inlet of the canister purge valve relative to the engine, the method of performing the leak detection test comprising:

pumping a gaseous medium through a flowpath that communicates the vapor confinement space to atmosphere;

measuring flow of gaseous medium through the flowpath;

selectively operating the pump;

processing the gaseous flow measurement of the flowmeter in accordance with an algorithm that detects a first state of stability of the gaseous flow measurement of the flowmeter while the pump is running and that detects a second state of stability of the gaseous flow measurement of the flowmeter while the pump is not running; and processing the value of the first state of stability of the gaseous flow measurement of the flowmeter and the value of the second state of stability of the gaseous flow measurement of the flowmeter.

39. The method set forth in claim 38 in which the step of processing the value of the first state of stability of the gaseous flow measurement of the flowmeter and the value of the second state of stability of the gaseous flow measurement of the flowmeter comprises comparing one to the other to ascertain the existence of any leakage from the vapor confinement space.

40. The method set forth in claim 34 in which the algorithm detects the first state of stability of the gaseous flow measurement of the flowmeter while the pump is running during a time prior to detecting the second state of stability of the gaseous flow measurement of the flowmeter while the pump is not running.

41. The method set forth in claim 38 in which the algorithm detects the first state of stability of the gaseous flow measurement of the flowmeter while the pump is running, thereafter detects the second state of stability of the gaseous flow measurement of the flowmeter while the pump is not running, and during time prior to detecting the first state of stability of the gaseous flow measurement of the flowmeter while the pump is running, detects an initial state of stability of the gaseous flow measurement of the flowmeter while the pump is not running.

42. The method set forth in claim 41 in which the algorithm comprises processing a value of the initial state of stability of the gaseous flow measurement of the flowmeter and a value of the second state of stability of the gaseous flow measurement of the flowmeter by detecting any difference between them that is indicative of change in accuracy of a portion of the electric circuit.

43. The method set forth in claim 42 in which the algorithm comprises invalidating a leak detection test if more than a predetermined difference is detected between the value of the initial state of stability of the gaseous flow measurement of the flowmeter and the value of the second state of stability of the gaseous flow measurement of the flowmeter.

44. The method set forth in claim 42 in which the algorithm comprises processing the value of the first state of the gaseous flow measurement of the flowmeter and the value of the second state of stability of the gaseous flow measurement of the flowmeter to ascertain any leakage from the vapor confinement space if the electric circuit detects less than a predetermined difference between the value of the initial state of stability of the gaseous flow measurement of the flowmeter and the value of the second state of the gaseous flow measurement of the flowmeter.

45. An assembly for use in a leak detection system operatively associated with an evaporative emission control system of an engine powered automotive vehicle for detecting leakage from a portion of a vapor confinement space which is upstream of an inlet of a canister purge valve relative to an engine, the assembly comprising:

a fluid pumping device;

a housing comprising a flowpath through which the fluid pumping device conveys gaseous fluid relative to the vapor confinement space incidental to a leakage detection test;

a flowmeter for measuring flow of gaseous medium through the flowpath;

the housing comprising plural housing parts in assembly relation cooperatively defining the flowpath;

a first of the housing parts comprising a first port for the flowpath; and a second of the housing parts comprising a walled tube forming a portion of the flowmeter;

wherein the housing further comprises a second port for the flowpath;

the flow conveyed by the fluid pumping device enters the flowpath at one of the ports and exits the flowpath at the other of the ports; and the entire flow relative to the vapor confinement space is equal to the entire flow conveyed by the fluid pumping device.

46. An assembly as set forth in claim 45 wherein the housing is constructed and arranged such that the entire flow through the flowpath flows through the walled tube forming a portion of the flowmeter.

47. An assembly for use in a leak detection system operatively associated with an evaporative emission control system of an engine powered automotive vehicle for detecting leakage from a portion of a vapor confinement space which is upstream of an inlet of a canister purge valve relative to an engine, the assembly comprising:

a fluid pumping device;

a housing comprising a flowpath through which the fluid pumping device conveys gaseous fluid relative to the vapor confinement space incidental to a leakage detection test;

a flowmeter for measuring flow of gaseous medium through the flowpath;

the housing comprising a first port for the flowpath; and the port comprising a walled tube forming a portion of the flowmeter;

wherein the housing further comprises a second port for the flowpath;

the flow conveyed by the fluid pumping device enters the flowpath at one of the ports and exits the flowpath at the other of the ports; and the entire flow relative to the vapor confinement space is equal to the entire flow conveyed by the fluid pumping device.

48. An assembly for use in a leak detection system operatively associated with an evaporative emission control system of an engine powered automotive vehicle for detecting leakage from a portion of a vapor confinement space which is upstream of an inlet of a canister purge valve relative to an engine, the assembly comprising:

a fluid pumping device;

a housing comprising a flowpath through which the fluid pumping device conveys gaseous fluid relative to the vapor confinement space incidental to a leakage detection test;

a flowmeter for measuring flow of gaseous medium through the flowpath;

the housing comprising a first port for the flowpath; and a wall that divides the first port into first and second flow branches each of which conveys a fraction of the total flow through the first port, one of the branches comprising the flowmeter;

wherein the housing further comprises a second port for the flowpath;

the flow conveyed by the fluid pumping device enters the flowpath at one of the ports and exits the flowpath at the other of the ports; and the entire flow relative to the vapor confinement space is equal to the entire flow conveyed by the fluid pumping device.

* * * * *